US011798374B2

(12) United States Patent
Andrews et al.

(10) Patent No.: US 11,798,374 B2
(45) Date of Patent: Oct. 24, 2023

(54) SYSTEMS AND METHODS FOR ADMINISTERING COMMUNITY GAMES

(71) Applicant: LNW Gaming, Inc., Las Vegas, NV (US)

(72) Inventors: Oliver Andrews, Bristol (GB); Alex Chapman, Bristol (GB); Adam Fox, Bristol (GB); Thomas Wood, London (GB)

(73) Assignee: LNW Gaming, Inc., Las Vegas, NV (US)

( * ) Notice: Subject to any disclaimer, the term of this patent is extended or adjusted under 35 U.S.C. 154(b) by 0 days.

(21) Appl. No.: 17/028,039

(22) Filed: Sep. 22, 2020

(65) Prior Publication Data

US 2021/0090404 A1 Mar. 25, 2021

Related U.S. Application Data

(60) Provisional application No. 62/905,035, filed on Sep. 24, 2019.

(51) Int. Cl.
*G07F 17/32* (2006.01)

(52) U.S. Cl.
CPC ..... *G07F 17/3272* (2013.01); *G07F 17/3223* (2013.01); *G07F 17/3258* (2013.01)

(58) Field of Classification Search
CPC ..... G07F 17/3272; G07F 17/3223; G07F 17/3258
See application file for complete search history.

(56) References Cited

U.S. PATENT DOCUMENTS

| | | | | |
|---|---|---|---|---|
| 7,516,959 | B2 | 4/2009 | Huard et al. | |
| 7,942,735 | B2 | 5/2011 | Meyer et al. | |
| 8,100,760 | B2 * | 1/2012 | Cannon | G07F 17/3241 463/25 |
| 8,202,165 | B2 | 6/2012 | Duhamel | |
| 8,317,620 | B2 | 11/2012 | Kelly et al. | |
| 8,449,386 | B2 | 5/2013 | Englman et al. | |
| 8,512,119 | B2 | 8/2013 | Kelly et al. | |
| 8,734,234 | B1 * | 5/2014 | Guase | A63F 13/50 463/16 |
| 8,852,001 | B2 | 10/2014 | Kelly et al. | |
| 8,992,326 | B2 | 3/2015 | Kelly et al. | |
| 9,033,786 | B2 | 5/2015 | Kelly et al. | |

(Continued)

*Primary Examiner* — Chase E Leichliter

(57) ABSTRACT

A bonus game server including game-logic circuitry that monitors a plurality of bonus ticket balances associated with a plurality of players and a bonus jackpot associated with a bonus tournament game, transmits, in response to an amount of the bonus jackpot exceeding an eligibility threshold, participation requests to player devices of eligible players for the bonus tournament game, initiates a participation timer, enters, in response to at least one of the eligible players accepting the participation request, the accepting eligible player into the bonus tournament game, generates, using a random number generator and in response to the participation timer reaching a concluding threshold, one or more random numbers to determine at least one outcome of the bonus tournament game, and awards a bonus game prize from the bonus jackpot to a winning player of the participating players identified at least partially by the determined outcome of the bonus tournament game.

20 Claims, 15 Drawing Sheets

(56) References Cited

U.S. PATENT DOCUMENTS 9,155,968 B2 10/2015 Hedrick et al.
9,177,445 B2 11/2015 Vemuri et al.
9,418,521 B1 * 8/2016 Henrick ..... G07F 17/3244
9,514,604 B1 * 12/2016 Cioe ..... A63F 13/573
9,607,479 B2 3/2017 Robbins et al.
9,715,790 B2 7/2017 Arnone et al.
10,032,338 B2 * 7/2018 Lark ..... G07F 17/323
10,475,284 B2 * 11/2019 LeMay ..... G07F 17/3244
10,510,215 B2 * 12/2019 Arnone ..... A63F 13/00
10,515,507 B2 12/2019 De Waal et al.
10,692,327 B2 * 6/2020 Barbalet ..... A63F 13/55
10,699,462 B1 * 6/2020 Baszucki ..... A63F 13/79
10,789,811 B2 * 9/2020 Herring ..... A63F 13/35
2005/0148380 A1 * 7/2005 Cannon ..... G07F 17/3211 463/16
2005/0181856 A1 * 8/2005 Cannon ..... G07F 17/32 463/16
2007/0293293 A1 * 12/2007 Baerlocher ..... G07F 17/3211 463/16
2008/0254883 A1 * 10/2008 Patel ..... G07F 17/3276 463/31
2010/0048282 A1 * 2/2010 Nicely ..... G07F 17/3211 463/20
2011/0014964 A1 1/2011 Crowder, Jr. et al.
2011/0111864 A1 * 5/2011 Englman ..... G07F 17/3267 463/42
2011/0143834 A1 * 6/2011 Guinn ..... G07F 17/32 463/43
2011/0244952 A1 * 10/2011 Schueller ..... G07F 17/3262 463/31
2012/0322545 A1 * 12/2012 Arnone ..... G07F 17/3286 463/25
2013/0079090 A1 * 3/2013 Johnson ..... G07F 17/3223 463/16
2013/0084941 A1 * 4/2013 Caputo ..... G07F 17/3244 463/16
2013/0123005 A1 * 5/2013 Allen ..... G07F 17/3223 463/29
2013/0196744 A1 * 8/2013 Earley ..... G07F 17/3255 463/25
2014/0228098 A1 * 8/2014 Englman ..... G07F 17/3276 463/25
2015/0287270 A1 * 10/2015 Caputo ..... G07F 17/34 463/20
2016/0225233 A1 * 8/2016 Arezina ..... G07F 17/323
2017/0084129 A1 * 3/2017 Baerlocher ..... G07F 17/3211
2017/0236373 A1 * 8/2017 Arnone ..... G07F 17/3262 463/25
2017/0323528 A1 11/2017 Arnone et al.
2019/0130701 A1 * 5/2019 Simons ..... H04L 9/0637
2019/0272707 A1 * 9/2019 Washington ..... A63F 13/837
2021/0090404 A1 * 3/2021 Andrews ..... G07F 17/3248

* cited by examiner

602

604

600

800
804
808
804
802
806

1000

1100

1300

1400

SYSTEMS AND METHODS FOR ADMINISTERING COMMUNITY GAMES

CROSS REFERENCE TO RELATED APPLICATIONS

This application claims the benefit of priority to U.S. Provisional Application No. 62/905,035, filed Sep. 24, 2019, the contents of which are hereby incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to managing and administering community games.

BACKGROUND

The gaming industry depends upon player participation. Players are generally "hopeful" players who either think they are lucky or at least think they can get lucky—for a relatively small investment to play a game, they can get a disproportionately large return. To create this feeling of luck, a gaming apparatus relies upon an internal or external random element generator to generate one or more random elements such as random numbers. The gaming apparatus determines a game outcome based, at least in part, on the one or more random elements.

A significant technical challenge is to improve the operation of gaming apparatus and games played thereon, including the manner in which they leverage the underlying random element generator, by making them yield a negative return on investment in the long run (via a high quantity and/or frequency of player/apparatus interactions) and yet random and volatile enough to make players feel they can get lucky and win in the short run. Striking the right balance between yield versus randomness and volatility to create a feeling of luck involves addressing many technical problems, some of which can be at odds with one another. This luck factor is what appeals to core players and encourages prolonged and frequent player participation.

Another significant technical challenge is to improve the operation of gaming apparatus and games played thereon by increasing processing speed and efficiency of usage of processing and/or memory resources. To make games more entertaining and exciting, they often offer the complexities of advanced graphics and special effects, multiple bonus features with different game formats, and multiple random outcome determinations per feature. The game formats may, for example, include picking games, reel spins, wheel spins, and other arcade-style play mechanics. Inefficiencies in processor execution of the game software can slow down play of the game and prevent a player from playing the game at their desired pace.

As the industry matures, the creativity and ingenuity required to improve such operation of gaming apparatus and games grows accordingly.

SUMMARY

According to one aspect of the present invention, a gaming system comprises a bonus game server including game-logic circuitry that monitors a plurality of bonus ticket balances associated with a plurality of players and that accrue bonus tickets during play of at least one base wagering game, monitors a bonus jackpot associated with a bonus tournament game and that is accrued at least partially from wagers placed during the base wagering game, in response to an amount of the bonus jackpot exceeding an eligibility threshold, transmits participation requests to player devices of eligible players from the plurality of players and that are associated with respective bonus ticket balances exceeding an eligibility amount, initiates a participation timer associated with the participation requests, in response to at least one of the eligible players accepting the participation request, enters the eligible player into the bonus tournament game and deducts a participation fee from the respective bonus ticket balance associated with the eligible player, in response to the participation timer reaching a concluding threshold, generates, using a random number generator of the bonus game server, one or more random numbers to determine at least one outcome of the bonus tournament game, and awards a bonus game prize from the bonus jackpot to a winning player of the participating players identified at least partially by the at least one outcome of the bonus tournament game.

According to another aspect of the invention, a method of conducting a bonus tournament game using a gaming system including a bonus game server is provided. The method may be at least partially performed using game-logic circuitry of the bonus game server. The method includes monitoring a plurality of bonus ticket balances associated with a plurality of players and that accrue bonus tickets during play of at least one base wagering game, monitoring a bonus jackpot associated with a bonus tournament game and that is accrued at least partially from wagers placed during the at least one base wagering game, transmitting, in response to an amount of the bonus jackpot exceeding an eligibility threshold, participation requests to player devices of eligible players that are associated with respective bonus ticket balances exceeding an eligibility amount, initiating a participation timer associated with the participation requests, entering, in response to at least one of the eligible players accepting the participation request, the at least one eligible player into the bonus tournament game and deducting a participation fee from the respective bonus ticket balance associated with the eligible player, generating, in response to the participation timer reaching a concluding threshold and by a random number generator of the bonus game server, one or more random numbers to determine at least one outcome of the bonus tournament game, and awarding a bonus game prize from the bonus jackpot to a winning player of the participating players identified at least partially by the at least one outcome of the bonus tournament game.

According to yet another aspect of the invention, a bonus game server including game-logic circuitry that monitors a plurality of bonus ticket balances associated with a plurality of players and that accrue bonus tickets during play of at least one base wagering game, monitors a bonus jackpot associated with a bonus tournament game, the bonus jackpot accrued at least partially from wagers placed during the at least one base wagering game, transmits, in response to an amount of the bonus jackpot exceeding an eligibility threshold, participation requests to player devices of eligible players associated with respective bonus ticket balances exceeding an eligibility amount, initiate a participation timer associated with the participation requests, enters, in response to at least one of the eligible players accepting the participation request, the at least one eligible player into the bonus tournament game and deducts a participation fee from the respective bonus ticket balance associated with the at least one eligible player, generates, in response to the participation timer reaching a concluding threshold and using a random number generator of the bonus game server, one or more random numbers to determine at least one outcome of the bonus tournament game, and awards a bonus game prize from the bonus jackpot to a winning player of the participating players identified at least partially by the at least one outcome of the bonus tournament game.

Additional aspects of the invention will be apparent to those of ordinary skill in the art in view of the detailed description of various embodiments, which is made with reference to the drawings, a brief description of which is provided below.

Figure 1:
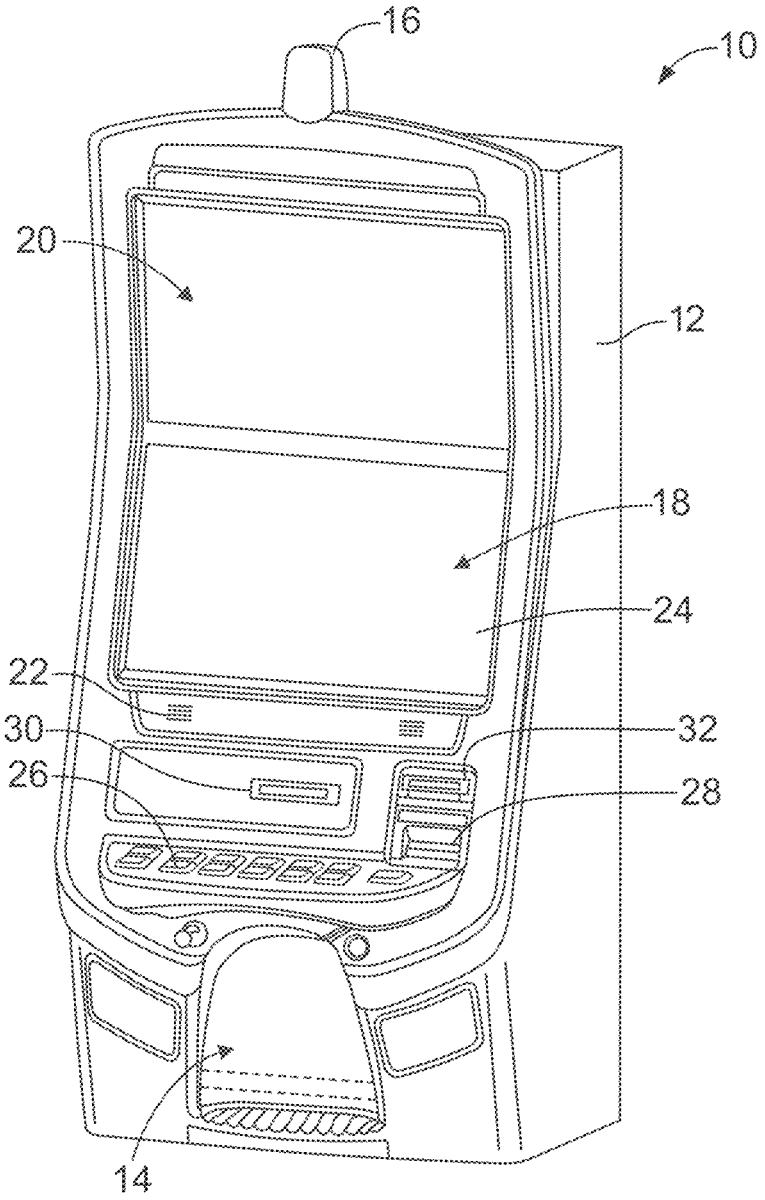
FIG. 1 is a perspective view of a free-standing gaming machine according to at least some embodiments of the present disclosure.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to FIG. 1, there is shown a gaming machine 10 similar to those operated in gaming establishments, such as casinos. With regard to the present invention, the gaming machine 10 may be any type of gaming terminal or machine and may have varying structures and methods of operation. For example, in some aspects, the gaming machine 10 is an electromechanical gaming terminal configured to play mechanical slots, whereas in other aspects, the gaming machine is an electronic gaming terminal configured to play a video casino game, such as slots, keno, poker, blackjack, roulette, craps, etc. The gaming machine 10 may take any suitable form, such as floor-standing models as shown, handheld mobile units, bartop models, workstation-type console models, etc. Further, the gaming machine 10 may be primarily dedicated for use in playing wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, which are incorporated herein by reference in their entireties.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. In order to deposit cash or credits onto the gaming machine 10, the value input devices are configured to detect a physical item associated with a monetary value that establishes a credit balance on a credit meter such as the "credits" meter 84 (see FIG. 3). The physical item may, for example, be currency bills, coins, tickets, vouchers, coupons, cards, and/or computer-readable storage mediums. The deposited cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 84 (see FIG. 3), the value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
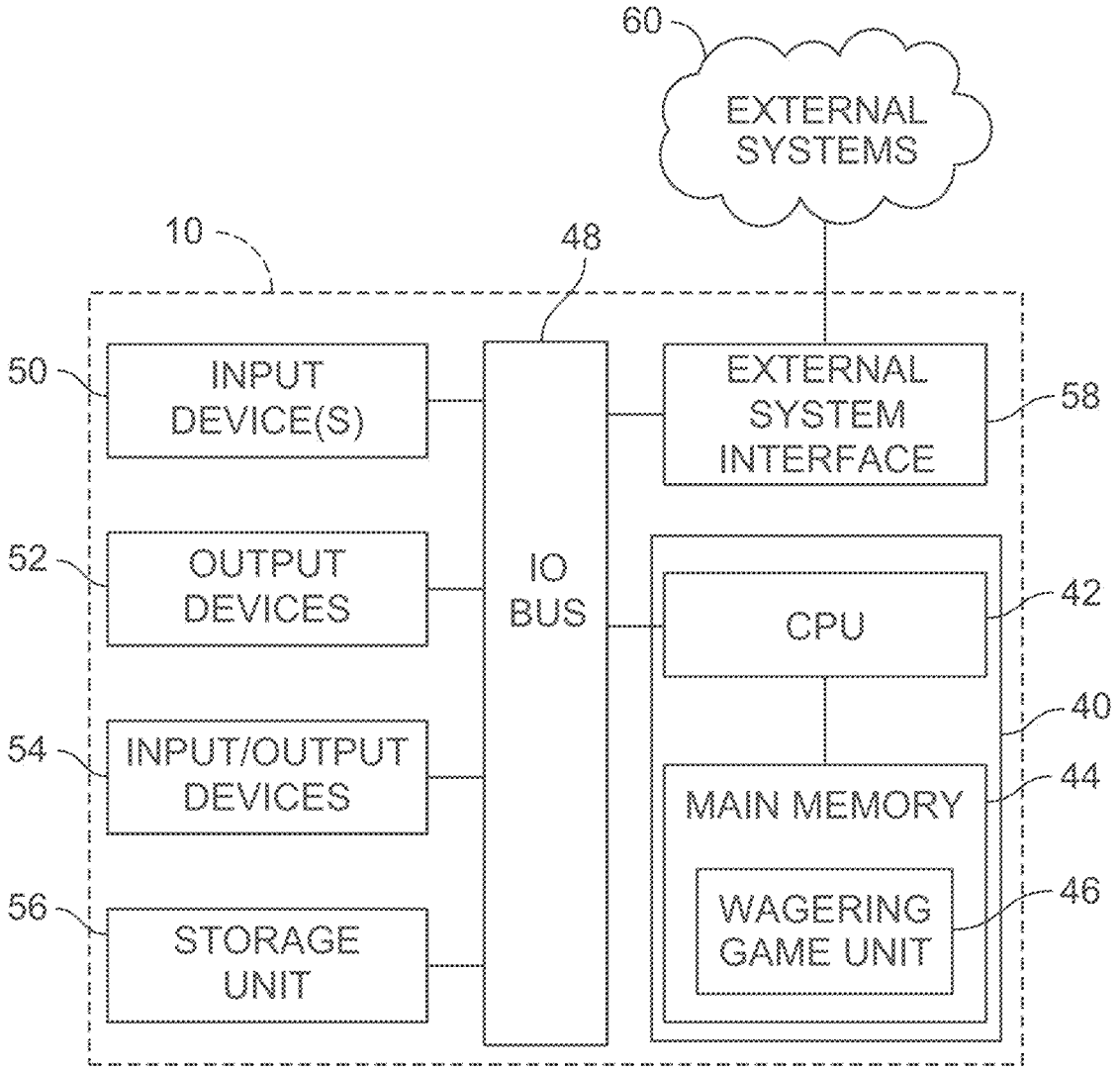
FIG. 2 is a schematic view of a gaming system according to at least some embodiments of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video blackjack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, bonus game servers as described herein, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
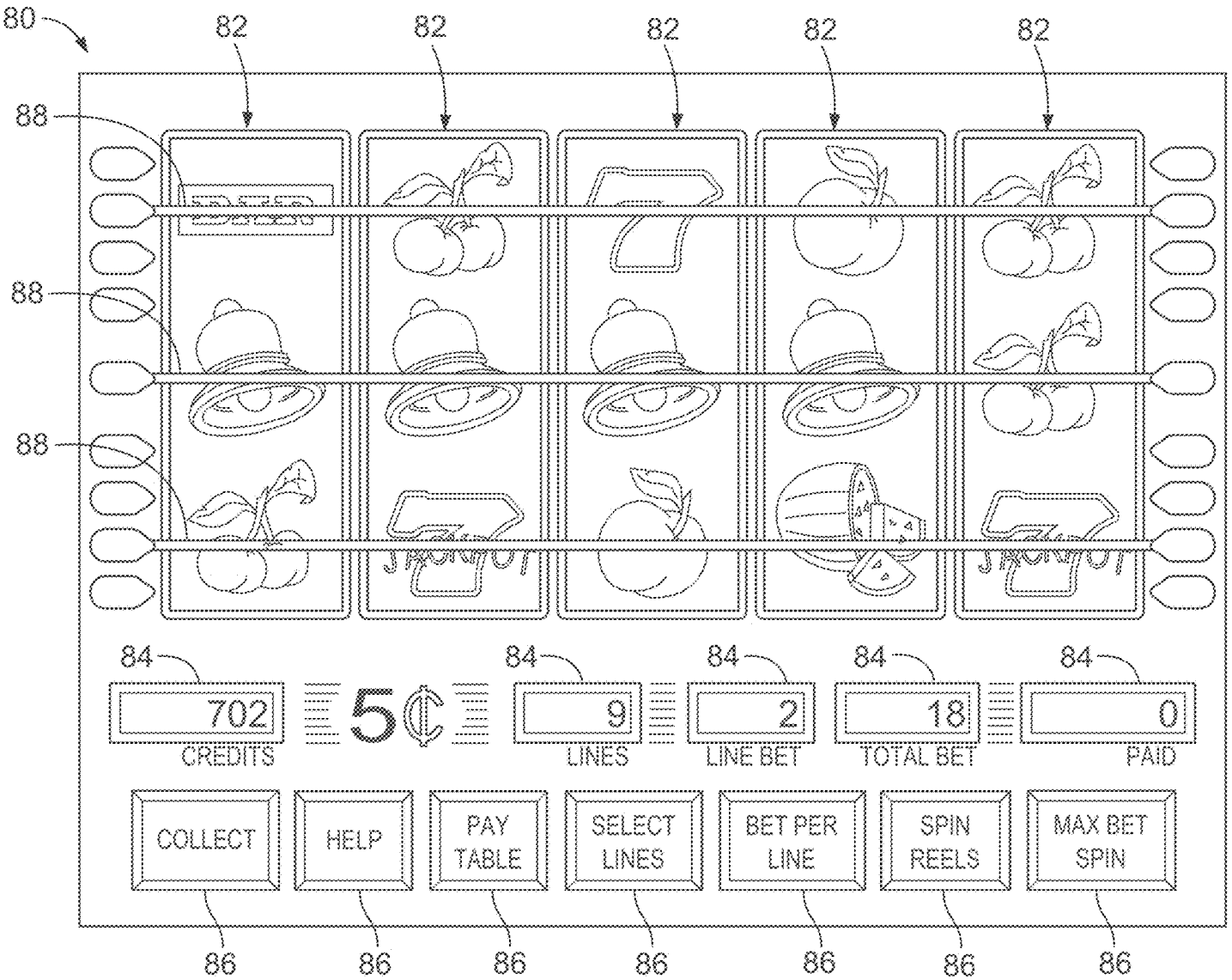
FIG. 3 is an image of an exemplary basic-game screen of a wagering game displayed on a gaming machine, according to at least some embodiments of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager covered by or deducted from the credit balance on the "credits" meter 84, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

The systems and methods described herein facilitate administering one or more community games. More specifically, the systems and methods described herein monitor a bonus jackpot and player eligibility for a community bonus game such that, in response to a trigger condition related to the jackpot (e.g., reaching a funding threshold), the systems and methods described herein notify eligible players that a bonus community game will begin to determine which eligible players will participate. Player eligibility may be determined at least in part on a ticket (or other suitable currency) balance for each player, where tickets are exchanged to participate in the community bonus game. The community bonus game may be conducted via a centralized server system that determines one or more outcomes of the bonus community game and sends the outcomes and/or other data related to the community bonus game (e.g., award information) to a plurality of player devices associated with the players participating in the community bonus game to be graphically represented at the player devices.

In some embodiments, the community bonus game may be a tournament bonus game in which a plurality of players compete for one or more prizes. The tournament bonus game may incorporate avatars associated with the players, where the avatars may be used to graphically depict the outcomes of the bonus tournament game. For example, the avatars may be used to depict the determined outcomes in the form of matches or battles between avatars and/or non-player characters (NPCs). In certain embodiments, the avatars may include one or more data elements that influence the outcomes determined by the server system administering the bonus tournament game. That is, the avatars may have data elements representing statistics and/or attributes having values such that a particular outcome is at least partially a function of the values of the statistics and/or attributes of the participating avatars. These data elements may be customizable by the players using a digital currency accrued from one or more player actions, such as participating in a base wagering game (e.g., the reel-based game shown in FIG. 3). Incorporating player-customizable avatars into the bonus game may enhance the player investment into the bonus game and may provide additional motivation to participate in the bonus game.

Figure 4:
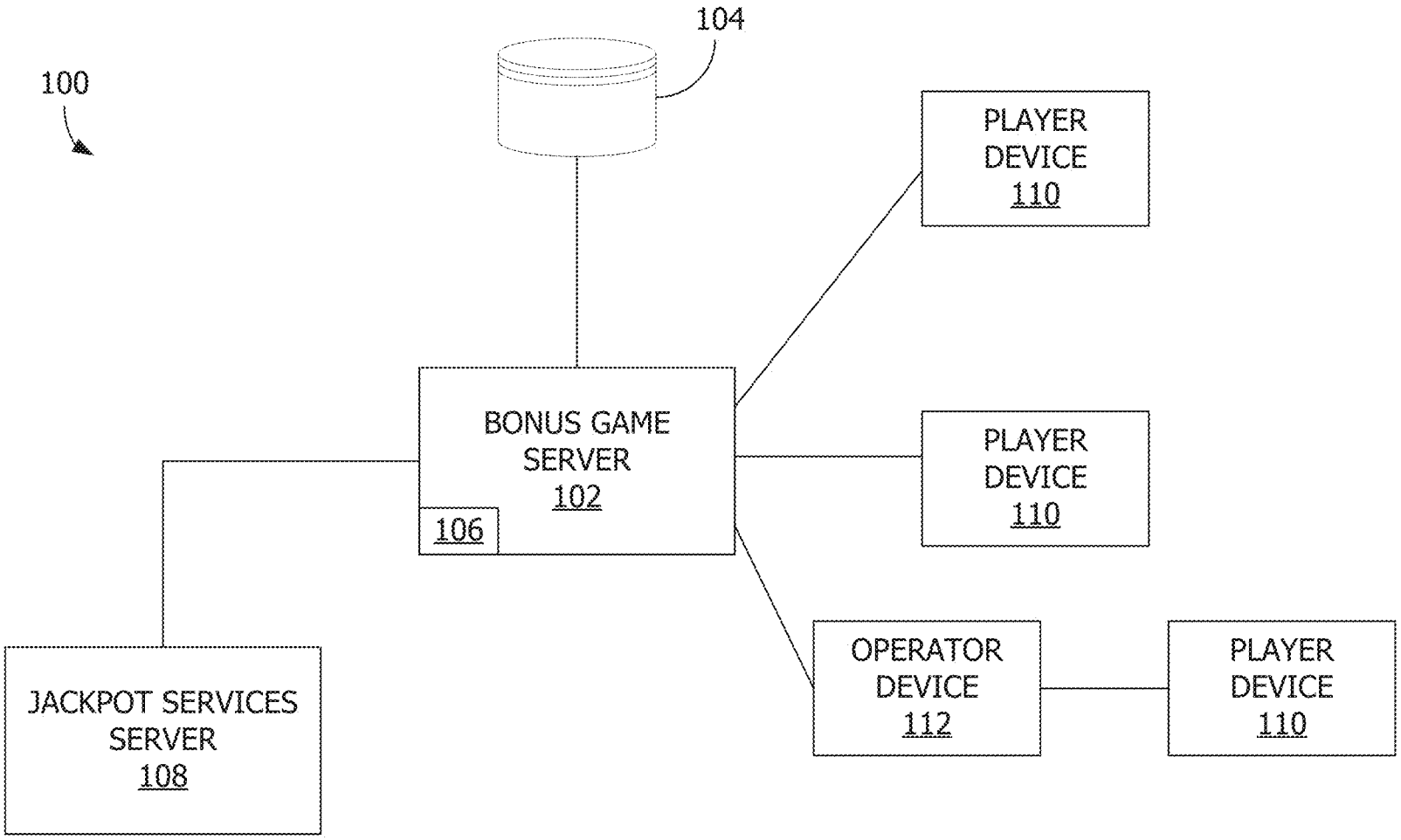
FIG. 4 is a block diagram of an exemplary bonus game system for administering a community bonus game, according to at least some embodiments of the present disclosure.

FIG. 4 illustrates an exemplary bonus game system 100 for administering a bonus game to a distributed player base. The system 100 includes a bonus game server 102 and a player database 104. In other embodiments, the system 100 may include additional, fewer, or alternative devices, including those described elsewhere herein.

The bonus game server 102 includes bonus game-logic circuitry 106 that may be substantially similar to the game-logic circuitry 40 shown in FIG. 2. In other embodiments, the bonus game-logic circuitry 106 may be distributed among a plurality of server devices in communication with each other to perform the functionality of the bonus game server 102 as described herein. That is, the bonus game server 102 may be a distributed server system or a centralized server system. In certain embodiments, the bonus game server 102 may be incorporated within one or more gaming machines that operate as hosts for a plurality of gaming machines, such as the gaming machine 10, shown in FIG. 1. As described in detail herein, the bonus game server 102, via at least partially the bonus game-logic circuitry 106, is configured to administer and manage a community bonus game. The community bonus game is a game in which a plurality of players compete (competitively, cooperatively, and/or independently with the other participating players) for one or more bonus game prizes.

In the example embodiment, the bonus game server 102 is in communication with a jackpot services server 108. The jackpot services server 108 is configured to manage funding, allocating, and/or distributing one or more jackpots. The jackpots may be specifically for the bonus game administered by the bonus game server 102, or the jackpots managed by the jackpot services server 108 may be for a plurality of games. In certain embodiments, the jackpot services server 108 may be at least partially incorporated within an accounting services system (not shown) that manages the flow of funds within a gaming environment and allocates available funds to gaming systems for game awards. In some embodiments, the bonus game server 102 may at least partially incorporate to the functionality of the jackpot services server 108. In one example, the jackpot services server 108 is incorporated into an accounting services system that allocates funds collected from one or more base games to a jackpot associated with the bonus game server 102, and the bonus game server 102 distributes awards from the jackpot for the bonus game.

In the example embodiment, the bonus game server 102 is communicatively coupled to a plurality of player devices 110 and one or more operator devices 112. The player devices 110 are devices associated with a respective player and are configured to present the bonus game to the players and/or receive user input from the players. The player devices 110 may include, but are not limited to, personal devices of the player (e.g., mobile phone, smart phone, tablet, laptop, desktop computer, etc.), gaming machines (e.g., the gaming machine 10, shown in FIG. 1), and/or kiosks or terminals accessible to the players. In some embodiments, at least some player devices 110 may be configured to conduct base wagering games (e.g., the reel-based game shown in FIG. 3).

In at least some embodiments, the identity of a player associated with a particular player device 110 may be indicated to the bonus game server 102 by a player account associated with the player. More specifically, the player and/or the player device 110 provide one or more identifiers to the bonus game server to link the player device 110 to a player account matching the one or more identifiers. The identifiers may include, but are not limited to, a username, a password, biometric information of the player, payment information, a player account number, and the like. In one example, the player may provide login credentials via a player account interface presented on the player device 110 to, at least temporarily, link the player account of the player to the player device 110. In another example, the player device 110 may include a card or ticket reader that is configured to detect a player card or ticket presented by the player and, based on the detection, link the player account of the player device 110.

Linking a player account to a player device 110 may enable the system 100 and/or other systems to provide features, benefits, and/or awards based on historical data stored with the player account. For example, persistence-based features, such as wagering via a digital wallet associated with the player account and/or player avatar game features, may be implemented and tracked across one or more player devices 110, different gaming sessions, and/or different gaming environments.

The operator device 112 may be one or more devices that monitor the activity of the bonus game server 102 to be relayed to one or more player devices 110 that may not be connected to the bonus game server 102. That is, the operator device 112 may act as a gateway between the bonus game server 102 and one or more player devices 110, which may include player devices 110 that may not accessible to the bonus game server 102. For example, in certain embodiments, the bonus game server 102 may only be communicatively coupled to player devices 110 that are active (i.e., linked to a player for play of a game), and the operator device 112 may push notifications from the bonus game server 102 to player devices 110 that are inactive (i.e., no current gaming session is detected) via one or more forms of communication, such as app notifications, cellular text message, email, and the like. It is to be understood that communicatively coupling the operator device 112 to a player device 110 in this context may not necessarily mean the operator device 112 and the player device 110 are directly connected (e.g., email notifications are routed to a cloud-based service accessible by the player device 110). Data and user input from the player devices 110 may also be transmitted to the bonus game server 102 via the operator device 112 to facilitate bi-directional communication. The inclusion of the operator device 112 may facilitate improved player awareness and participation in the bonus game.

In some embodiments, at least a portion of the data associated with player accounts may be stored in the player database 104. In the example embodiment, as described in detail further below, the player database 104 may store data associated with one or more digital currency or ticket balances and/or player avatar data. The player database 104 includes one or more data storage devices that store data associated with players in a structured format such that the stored data may be parsed, filtered, and/or compared to a set of input data in a suitable database query format. For example, a lookup query may be performed to determine whether or not the player database 104 stores data matching the input data. The player database 104 may be centrally located in a single device or distributed among a plurality of computing devices. The player database 104 may be dedicated to the system 100 to store data associated with the functionality of the bonus game server 102 or may include data storage accessible by a plurality of systems. For example, if the player database 104 stores the player accounts, the player database 104 may be accessible by (and, in some embodiments, integrated with) a player account services system (not shown) and/or other gaming systems. In certain embodiments, the player database 104 may be integrated with the bonus game server 102 such that the data stored by the player database 104 is locally accessible by the bonus game server 102.

In the example embodiment, the bonus community game administered and/or managed by the bonus game server 102 has one or more jackpot awards. As used herein, a "jackpot award" is an award that is funded from a bonus jackpot. That is, the jackpot award may be a portion or the entirety of the amount of the bonus jackpot. The jackpot awards may be fixed amounts or a percentage of the available funds of the bonus jackpot. In the example embodiment, the jackpot services server 108 manages the bonus jackpot, and distributes the jackpot awards from the bonus jackpot. The bonus jackpot may be a progressive jackpot that is allocated funds that may then be awarded to players at least through the play of the bonus community game. The funds may be collected from wagers and/or secondary wagers placed during one or more base wagering games. That is, at least a portion of the wagers and/or secondary wagers are allocated to the bonus jackpot. In other embodiments, additional or alternative funding methods may be employed to allocate funds to the bonus jackpot.

To prevent the bonus community game from being conducted with an underfunded bonus jackpot (i.e., the total amount allocated to the bonus jackpot is less than the jackpot awards and/or a minimum award amount), initiation of the bonus community game may be at least partially tied to the amount of the bonus jackpot available to be awarded. That is, the bonus game server 102 may monitor the bonus jackpot via the jackpot services server 108 to determine whether or not the bonus jackpot has been sufficiently funded before initiating the bonus community game. In response to detecting the bonus jackpot has exceeded one or more thresholds, the bonus game server 102 may initiate the bonus community game or, as in the example embodiment, begin an eligibility process to determine which players are eligible to participate.

In the example embodiment, the eligibility of players for the bonus community game is determined at least partially on respective bonus ticket balances of each player. More specifically, bonus tickets may be digital objects or currency accrued by a player and "stored" in a bonus ticket balance that may be stored by the player database 104. In one example, the bonus tickets are accrued based on wager amount and/or frequency of the player during one or more base wagering games such that increasing the amount and/or frequency of wagers over a period of time may increase the number of tickets awarded to the player. It is to be understood that the bonus tickets described herein may be referred to and/or appear as other suitable forms of digital (or physical) currency or objects that can be accumulated by the player for play of the bonus community game described herein.

In the example embodiment, eligibility for the bonus community game is tied to a number of bonus tickets. That is, in the example embodiment, to be eligible for the bonus community game, a player must have a sufficient number of bonus tickets for the bonus community game. In certain embodiments, other methods or conditions of eligibility may be present such that either (i) additional conditions may need to be satisfied to be eligible or (ii) other paths to eligibility are available to the players.

To participate in the bonus game, the players may spend tickets to participate. That is, the bonus game may have an entry or participation fee that, in response to the player agreeing to participate, is deducted from the participating player's ticket balance. In other embodiments, the bonus game may not have an entry fee, but rather has a ticket threshold for eligibility such that players participate without deducting from the bonus ticket balances of the players. In such embodiments, the bonus ticket balances may be reset or reduced in response to other conditions or events. In one example, the bonus ticket balances may reset after a period of inactivity. In another example, the bonus tickets may be used within a digital storefront to purchase items and/or services.

In the example embodiment, the bonus game server 102 is configured to monitor the bonus jackpot to determine whether the available funds allocated to the bonus jackpot exceeds at least one eligibility threshold amount. Multiple eligibility thresholds may be used for a plurality of bonus games having different jackpot awards as described herein. The bonus game server 102 may communicate with the jackpot services server 108 at a predetermined frequency (i.e., polling) to determine the current bonus jackpot amount, or the jackpot services server 108 may be configured to notify the bonus game server 102 when the eligibility threshold has been exceeded. In response to the bonus jackpot exceeding the eligibility threshold, the bonus game server 102 determines which, if any, players are eligible for participation in the bonus community game. The bonus game server 102 may perform a lookup within the player database 104 of a plurality of bonus ticket balances.

The bonus game server 102 may be configured to transmit participation requests to the players associated with bonus ticket balances exceeding an eligibility amount. More specifically, the participation requests are transmitted to player devices 110 of the eligible players. For players associated with a plurality of player devices 110 (e.g., a player having a smartphone and that is logged-in at a gaming machine), the bonus game server 102 may transmit the participation request to every player device 110 or one or more prioritized player devices 110. The participation request indicates to the player that he or she is eligible for an upcoming bonus community game and prompts the player to accept or decline an invitation to participate.

In some embodiments, the participation request is a message presented to the player. For example, the participation request may be an email or text message that is sent to an email address or phone number of the player. In other embodiments, the participation request is an underlying message to the player device 110 that causes the player device 110 to provide the player with the option to accept the request. For example, an application associated with the system 100 and executed on the player device 110 may make a previously unselectable option to participate in the bonus game selectable in response to the participation request.

In at least some embodiments, the eligible players may be given a predetermined period of time (e.g., thirty minutes) to determine whether or not to accept the participation requests. To participate, a player may provide user input indicating acceptance of the participation request at the player device 110. The user input (or indications thereof) may be transmitted by the player device 110 back to the bonus game server 102 for recording which players are participating and to change the bonus ticket balance accordingly (i.e., deduct a participation fee from the player's bonus ticket balance). At the conclusion of the predetermined period of time, the roster of participating players may be locked in, and the bonus community game is conducted. In at least some embodiments, the bonus community game may require a minimum number of participating players and/or have a maximum number of participating players. To reach the minimum number of participating players, the predetermined period of time may be extended until the minimum number is reached. If the maximum number of participating players is reached, subsequent players may not able to enter the bonus community game via the participation requests.

In the example embodiment, the bonus jackpot for the bonus game is funded up to the initiation of the bonus game. That is, wagers occurring during the predetermined period of time in which players elect to participate in the bonus game fund the bonus jackpot. After the bonus game begins, the next bonus jackpot is "seeded" (i.e., an amount of reserved funds used to initially fund a jackpot to accelerate accumulation of funds in the bonus jackpot, thereby increasing the frequency of the bonus game), and subsequent wagers fund the next bonus jackpot. In other embodiments, the transition between a bonus jackpot and the next bonus jackpot may occur at a different time, in response to a different, and/or may include a period of overlap.

The bonus community game may be conducted, and one or more jackpot awards from the bonus jackpot are provided to one or more participating players at the conclusion of the bonus community game (or after each round of the bonus community game). Other awards may also be awarded during and/or at the conclusion of the bonus community game, such as a virtual currency or tickets. The bonus game server 102 may manage the play of the bonus community game and the corresponding awards. For jackpot awards, the bonus game server 102 may notify the jackpot services server 108 which players to attribute with the jackpot awards. After the bonus community game has concluded, the bonus jackpot then continues to receive funds to fund a subsequent bonus community game.

Figure 5:
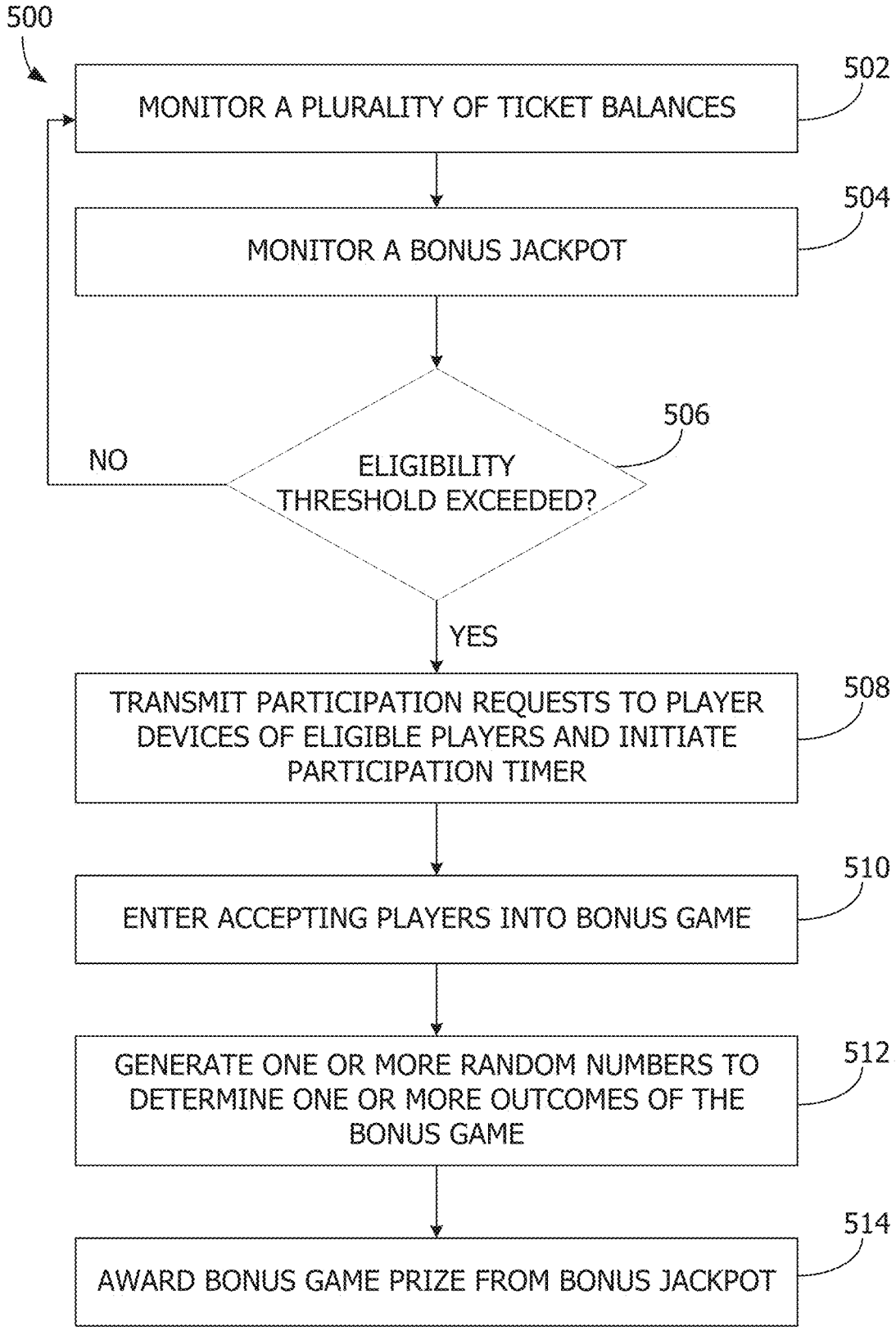
FIG. 5 is a flow diagram of an exemplary method of administering a community bonus game using the system shown in FIG. 4, according to at least some embodiments of the present disclosure.

FIG. 5 is a flow diagram of an example method 500 of administering a bonus game using the system 100 (shown in FIG. 4). In the example embodiment, the steps of the method 500 are at least partially performed by the bonus game server 102 (shown in FIG. 4). In other embodiments, the method 500 may be at least partially performed by another device or system (e.g., the player device 110, shown in FIG. 4), and/or may include additional, fewer, or alternative steps, including those described elsewhere herein.

With respect to FIGS. 4 and 5, in the example embodiment, the bonus game server 102 monitors 502 ticket balances for a plurality of players. The tickets may be accrued in response to one or more actions associated with the bonus game, such as participation (e.g., wagers, spins, awards, etc.) in one or more base wagering games and/or purchases associated with the bonus game (e.g., purchasing digital items via a store linked to the bonus game). In some embodiments, the bonus game server 102 may only monitor ticket balances of active players. An "active player" may refer to a player that is participating in a wagering game via the player devices 110 and/or players that have logged-in with a player account at a player device 110 detectable by the bonus game server. In other embodiments, the bonus game server 102 may also monitor ticket balances for inactive players.

The bonus game server 102 also monitors 504 a bonus jackpot. More specifically, the bonus game server 102 monitors 504 a jackpot amount accrued within the bonus jackpot by communicating with the jackpot services server 108. The bonus game server 102 may periodically poll the jackpot services server 108 for the current jackpot amount, and/or the jackpot services server 108 may notify the bonus game server in response to one or more thresholds being exceeded by the jackpot amount. Polling the jackpot services server 108 enables the bonus game server 102 to have an up-to-date jackpot amount that can be presented to the players as another form of excitement for the bonus game. Notification in response to a threshold being exceeded many reduce that computing, memory, and/or network resource burden of the bonus game server 102 and/or the jackpot services server 108 in monitoring the bonus jackpot, thereby freeing such resources for other tasks. In certain embodiments, combinations of such synchronous (polling) and asynchronous (threshold-based notification) forms of communication may be used.

In the example embodiment, the bonus game server 102 determines 506 whether or not the jackpot amount of the bonus jackpot has exceeded an eligibility threshold. The eligibility threshold begins an eligibility period for the bonus game in which players deemed eligible for the bonus game based on their monitored ticket balances can selectively choose to participate in the bonus game. In the example embodiment, the eligibility threshold is set at a jackpot amount below full funding of the jackpot awards for the bonus game such accrual of funds for the bonus jackpot is likely to reach the full funding amount. In other embodiments, the eligibility threshold may be set at a jackpot amount at which full funding for the bonus game has already been achieved. In such embodiments, funding of a subsequent bonus jackpot may begin during the eligibility period.

If the bonus game server 102 determines 506 that the eligibility threshold has not been reached, the bonus game server 102 continues to monitor 502, 504 the ticket balances and the bonus jackpot. However, if the bonus game server 102 determines 506 that the eligibility threshold has been exceeded, the eligibility period begins. The bonus game server 102 compares the ticket balances to an amount of tickets required to participate. In the example embodiment, the amount of tickets required to participate may be a participation fee. The bonus game server 102 then transmits 508 participation requests to the player devices 110 of the eligible players that have enough tickets to afford the participation fee. The participation requests may be a message sent to the player devices 110 that the player can view, or the participation request may be an underlying message to the player device 110 to visually and/or audibly notify the player that a bonus game is available for participation.

The eligible players are given the option to participate in the bonus game. That is, the participation requests are not mandatory, and a player may choose to save his or her tickets for subsequent bonus games and/or other events or items associated with the tickets. In one example, the bonus game may include different bonus game features having different participation fees and bonus game prizes, and a player may ignore bonus game features with cheaper participation fees in pursuit of a bonus game feature having a larger participation fee and larger bonus game prizes. To decline participation in the bonus game, the player may ignore the participation request or provide user input indicating his or her intent to decline. To participate, the player provides user input to confirm participation. The user input (or a message representing the user input) may then be transmitted to the bonus game server 102.

The bonus game server 102 receives the user input or corresponding messages and enters 510 the accepting players into a roster of participating players for the bonus game. The accepting players have been "locked-in" as participants once the bonus game starts. The roster of participating players may have a minimum and/or a maximum number of players to conduct the bonus game. If the roster of participating players is at least at the minimum number of players (also sometimes referred to herein as a "minimum participation threshold"), the bonus game may be conducted.

In the example embodiment, the bonus game server 102 initiates a participation timer at the beginning of the eligibility period. The participation timer and the maximum number of participating players may be used to determine the conclusion of the eligibility period and to begin the bonus game. That is, if the participation timer reaches a concluding threshold (e.g., zero for a countdown timer), the bonus game server 102 checks to see if the minimum number of participants are on the roster. If the minimum number has been reached, the eligibility period concludes and the bonus game is initiated with the participating players on the roster. If the minimum number of players has not been reached, the timer is extended until the minimum is reached. In one example, the participation timer is set for thirty minutes, and the timer is increased in three-minute intervals until the minimum number of players is reached. Similarly, if the maximum number of participating players is reached, the eligibility period may conclude irrespective of the participation timer.

Once the bonus game begins, the bonus game server 102 generates 512 one or more random numbers to determine one or more outcomes of the bonus game. For example, the random numbers may be compared to a list of numbers that represent outcomes. In another example, the outcomes may be a function of one or more random numbers in combination with one or more predetermined values. An example provided in detail below is a bonus tournament game in which players can customize avatars with stat-based customization that battle against avatars of other players. The outcomes of avatar matches in such an example may be functions of the random numbers and the stats of the customization elements of the battling avatars.

In the example embodiment, the bonus game server 102 generates 512 the random numbers to determine every outcome of the bonus game at the start of the bonus game. The outcomes are then transmitted to the player devices 110 to be presented sequentially and in "real-time" according to the presentation of the bonus game at the player devices 110. That is, although every outcome is known by the bonus game server 102 at the beginning of the bonus game, the bonus game is presented as if each outcome was determined separately over the duration of the community game. For example, in a bonus tournament game having bracket-based matchups, the bonus game server 102 determines the outcomes of every matchup at the beginning of the bonus tournament game. However, each outcome is revealed over time to the players in response to the corresponding matchup being presented at the player devices 110. Each outcome may include a timestamp or other synchronizing data element to facilitate the player devices 110 presenting each outcome at substantially the same time. By determining every outcome at once, the bonus game server 102 frees up computing, memory, and/or networking resources for reallocation to other tasks (such as resolving awards for the bonus game and monitoring subsequent bonus jackpots). Additionally, determining every outcome may enhance the robustness of the system in the event of player devices 110 disconnect from the bonus game server 102 during the bonus game. That is, the disconnected player device 110 may continue to present the bonus game to the player without requiring real-time information from the bonus game server 102.

During the bonus game or at the conclusion of the bonus game, one or more bonus game prizes may be awarded 514 by the bonus game server based on the determined outcomes. The bonus game prizes may include, but are not limited to, jackpot awards, ticket awards, other digital currency awards, patron awards (e.g., free food, drinks, and/or accommodations), and/or combinations thereof. In at least some embodiments, the jackpot awards may be reserved for one or more top or winning players of the bonus game. For example, in a bonus tournament game, the top three players may receive scaled jackpot awards (i.e., the top player receives a relatively larger award in comparison to awards received by the second and third players), while other players may receive digital currency awards. The bonus game server 102 may notify the player devices 110 of the winners Based on the type of award, the bonus game server 102 may notify one or more other devices to apply the awards to the correct players. For example, the bonus game server 102 may notify the jackpot services server 108 and/or an accounting server (not shown) that manages wagers and awards in a gaming environment of the jackpot awards to credit the winning players with the jackpot awards. Other awards, such as ticket awards, may be managed by the bonus game server 102.

During the bonus game, the subsequent bonus jackpot may be accruing funds for play of another bonus game. Accordingly, the method 500 may repeat again for the subsequent jackpot and bonus game such that the players are periodically provided with new chances to enter in the bonus game.

In certain embodiments, the bonus game may be a bonus tournament game in which the participating players compete to determine a winning player and/or a ranking. The ranking may be used to provide awards corresponding to at least some of the players' performance in the bonus tournament game. That is, a winning player may receive the highest reward, the second-rank player receives the second highest reward, and so forth. The bonus tournament game may employ any suitable techniques, formats, and/or themes that employ non-skill, skill, and/or player customization to facilitate tournament play. The outcomes of the matches and the tournament may be determined at least partially as a function of randomly generated values and player-selected customization elements of the avatars. The player avatars may be persistent such that the player may customize the avatars over time and participate in a plurality of bonus tournament games.

Figure 13:
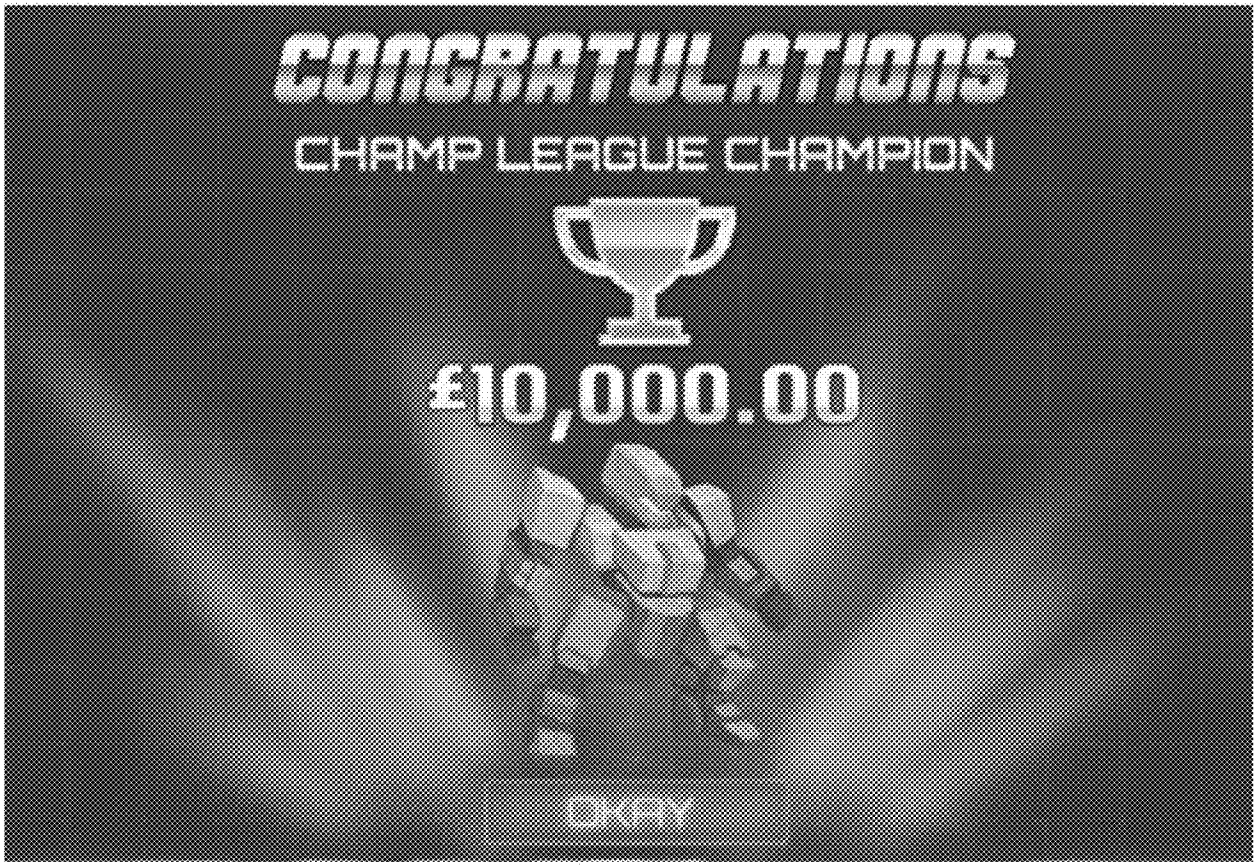
FIG. 13 is an image of an exemplary graphical interface for a winning player of an example tournament bonus game, according to at least some embodiments of the present disclosure.
Figure 14:
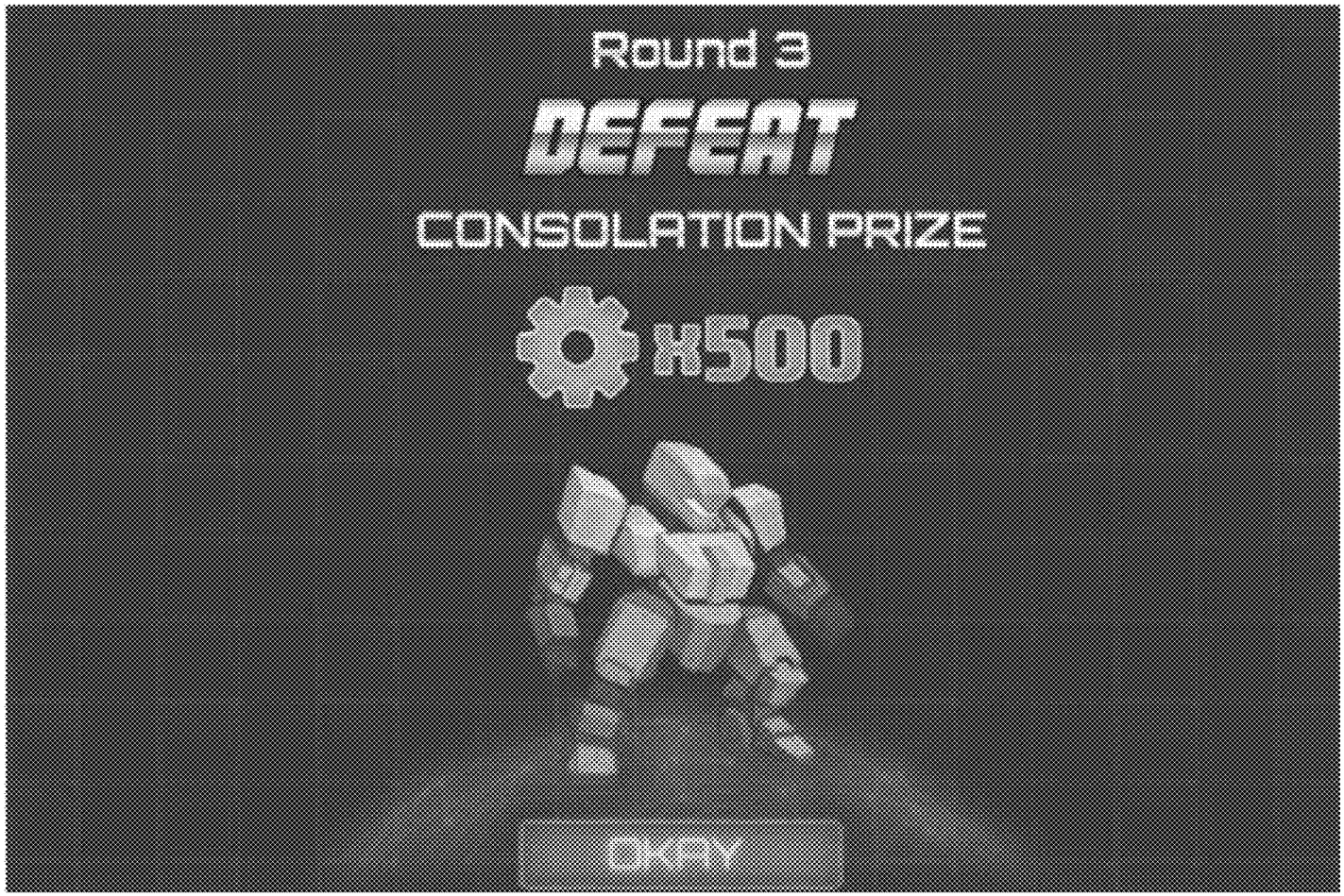
FIG. 14 is an image of an exemplary graphical interface of a consolation prize of an example tournament bonus game for a losing player, according to at least some embodiments of the present disclosure.
Figure 15:
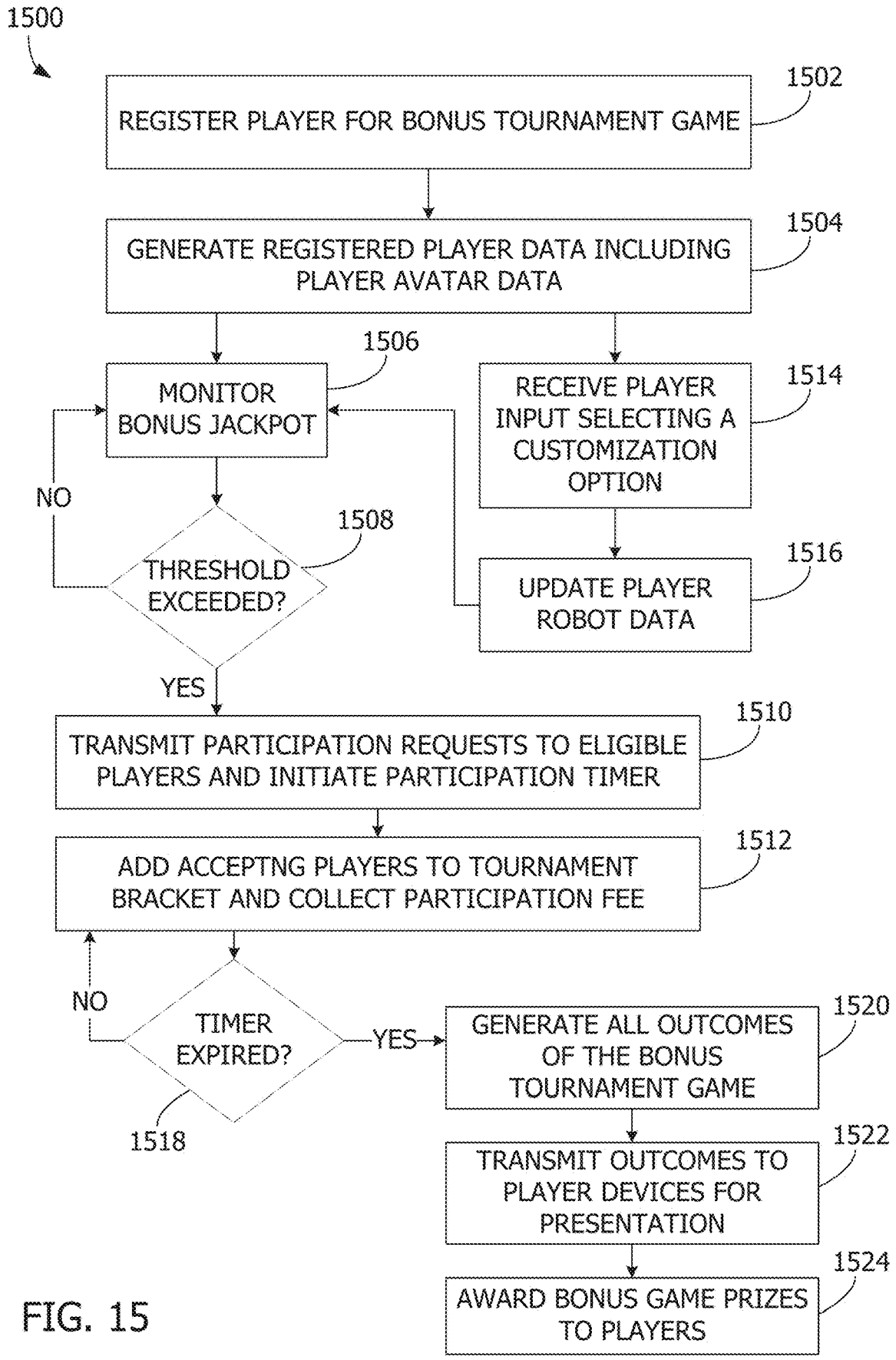
FIG. 15 is a flow diagram of an example method of administering a tournament bonus game with respect to the exemplary graphical interfaces shown in FIGS. 6-14, according to at least some embodiments of the present disclosure.

FIGS. 6-14 illustrate graphical interfaces of an example bonus tournament game that uses customizable player avatars to participate in a match-based tournament, and FIG. 15 is a flow diagram of an example method 1500 for administering the example bonus tournament game. In the example embodiment, the bonus tournament game is depicted as a tournament between player-customized robots. In other embodiments, other suitable themes may be used to implement the bonus tournament game.

Figure 6:
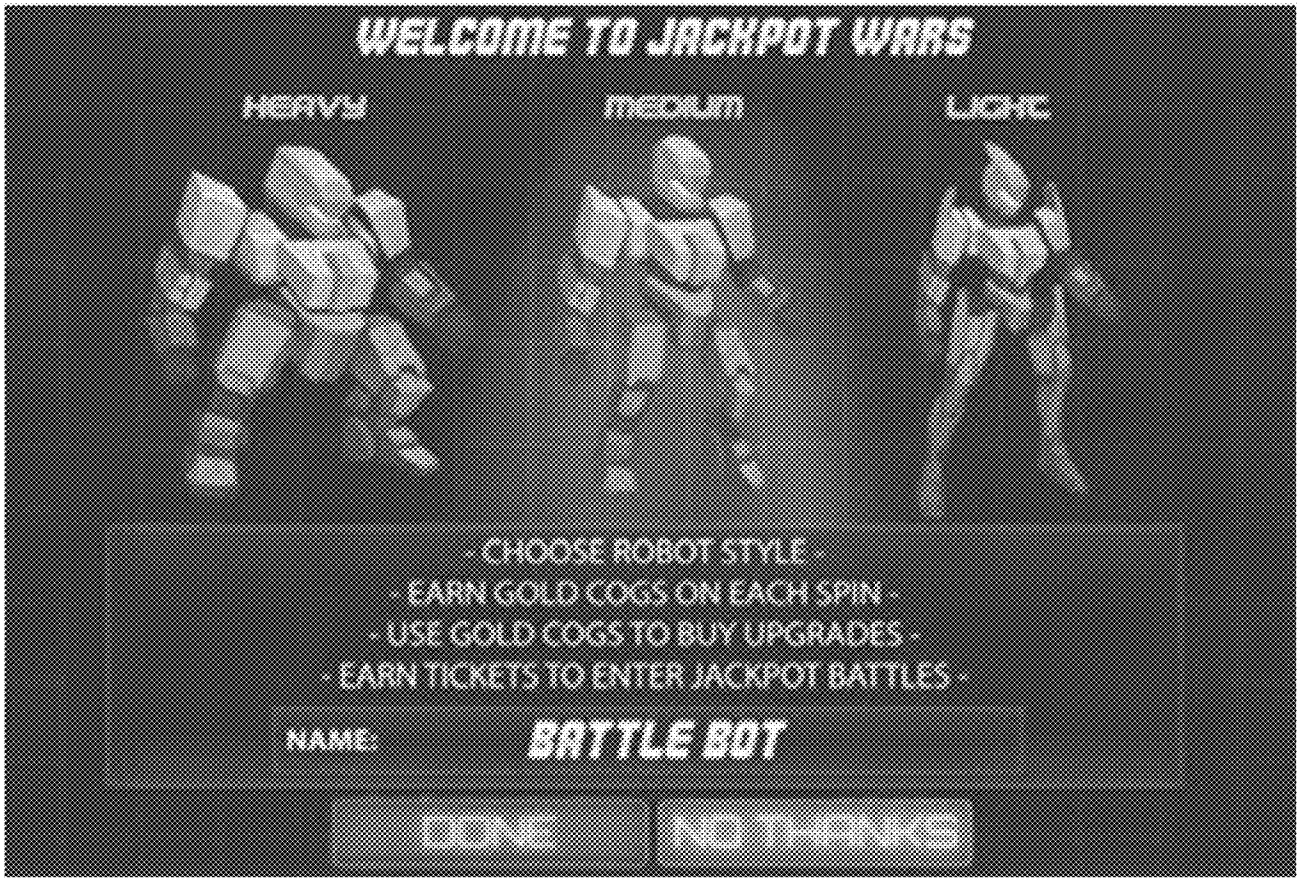
FIG. 6 is an image of an exemplary graphical interface for a registration process of an example tournament bonus game, according to at least some embodiments of the present disclosure.

To participate in the bonus tournament game, a player may be required to register 1502. FIG. 6 illustrates an example graphical interface 600 for registering 1502 the player for the bonus tournament game. The interface 600 may be presented to the player via one or more player devices (e.g., the player devices 110, shown in FIG. 4) automatically or in response to user input from the player. In one example, the player device may automatically present the interface 600 when a game or application associated with the bonus tournament game is initiated or after a predetermined period of time. In another example, in a different graphical interface (e.g., the interface presenting gameplay of a base wagering game), a button or tab may be provided that, when selected by the player, causes the registration interface 600 to be presented.

In the example embodiment, the registration interface 600 provides the player with information about how the bonus tournament game is conducted and several options to be customized by the player. More specifically, the registration interface 600 includes a robot selection portion 602 and a tournament information portion 604. The robot selection portion 602 includes three different types of robot avatars from which the player can select: heavy, medium, and light. In certain embodiments, the type of robot may merely be a visual difference. In other embodiments, the type of robot may affect which tournaments the player can participate in (e.g., heavy robot-only tournaments), customization options, and/or the outcomes of matches between robots as described herein. The tournament information portion 604 provides information to the player to understand how to participate in the bonus tournament game. As indicated in the tournament information portion 604, "gold cogs" are a digital currency accrued to customize the robots, and "tickets" are a digital currency accrued to participate in "jackpot battles" (i.e., the bonus tournament game). The tournament information portion 604 also includes a box for the player to add a name to be displayed during the tournament. Once the player has selected his or her desired name and robot type, the player may confirm their selection to complete the registration process.

The bonus game server 102 (shown in FIG. 4), in response to the registration by the player, may generate 1504 registered player data associated with the player. The registered player data may include, and is not limited to, a player identifier, robot data (e.g., robot type, customization elements, etc.), ticket balance of the player, cog balance of the player, and/or the like. In at least some embodiments, the registered player data may include contact information for the player, such as an email address, phone number, IP address, device address, and the like. The registered player data may be stored together (e.g., in the player database 104, shown in FIG. 4) or separately via one or more linking data elements. For example, the player's cog and ticket balances may be stored separately from the robot data, but are linked together via a pointer and/or a shared identifier (e.g., the player identifier).

In some embodiments, the registered player data may be retrieved from, stored with, and/or linked to existing data associated with a player to facilitate additional features and/or benefits. For example, the player may have a player account linked to the registered player data. The player account may store contact information for the player, and track historical performance of the player. In another example, the player may link a digital wallet to the registered player data to purchase cogs, tickets, and/or customization elements.

As mentioned above, tickets and cogs may be accrued at least by participating in one or more base games. In particular, in the example embodiment, tickets are awarded to a player as a function of an amount wagered over a predetermined period of time. That is, a number of tickets awarded to a player may increase in response to an increase in wager frequency and/or wager amount. For example, a player that wagers 2 units over ten minutes may earn the same number of tickets as another player that wagers 20 units over one minute, while a third player wagering 30 units over one minute would earn more tickets than the first or second players. The cogs may be awarded in response to each spin or round of the base games, or in response to other trigger conditions occurring in the base games, such as a particular outcome. In one example, the number of cogs awarded for each spin may be random or based on wager frequency and/or amount. As tickets and cogs are accrued by the player, the ticket and cog balances are automatically updated to add the accrued tickets and cogs.

In some embodiments, the player devices 110 from which the players are playing base wagering games may store the ticket and cog balances locally to maintain an up-to-date record of the balances such that the player devices 110 may update the bonus game server 102 of the balances at a reduced frequency, thereby reducing the networking, computing, and/or memory resource allocation to balance management by the bonus game server 102. In certain embodiments, robot data and/or other registered player data may also be stored at least during play of the wagering game and/or the bonus tournament game. In certain embodiments, local storage at the player devices 110 may be temporary such that if the player is unassociated with the player device 110 or the player device 110 enters an inactive state (e.g., on a smartphone, the player minimizes an application associated with the base wagering game and/or the bonus tournament game), the local storage may be deleted, unallocated (i.e., other programs may overwrite the local storage of the player data), and/or otherwise removed.

Figure 7:
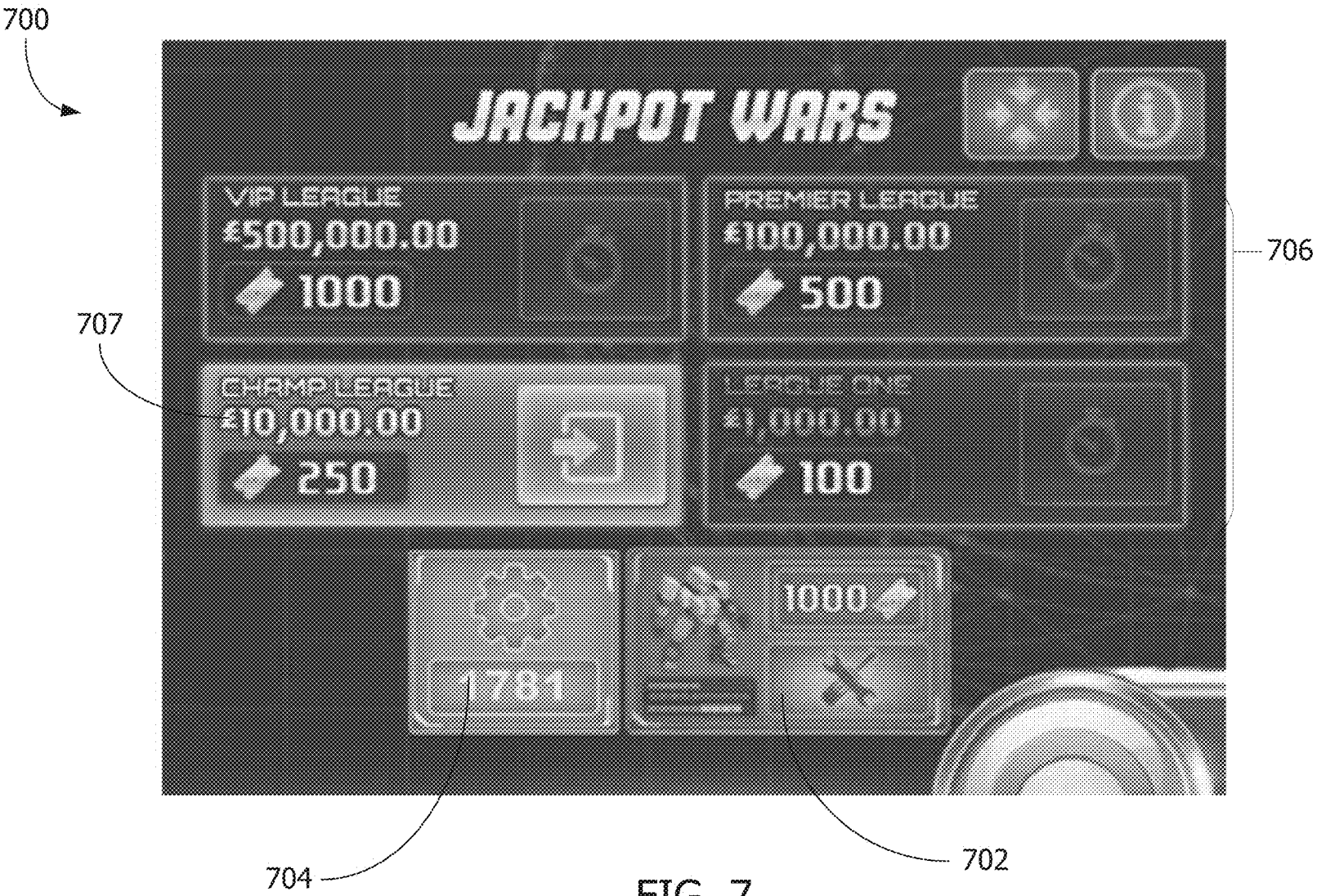
FIG. 7 is an image of an exemplary graphical interface indicating a player and tournament status for an example tournament bonus game, according to at least some embodiments of the present disclosure.

During play of the one or more base wagering games, the player may access an information interface to display various information about the player's ticket and cog balances, the player's avatar, and/or the available bonus tournament games. FIG. 7 is an example information interface 700 that the player may access. The information interface 700 includes a status panel 702, a cog panel 704, and a plurality of tournament panels 706. In other embodiments, the information interface may include additional, fewer, or alternative panels and other information elements, including those described elsewhere herein.

The status panel 702 provides a brief overview of the player's avatar and the player's ticket balance. That is, at a glance, the player can view at least some statistics of the avatar and an image of the avatar. In addition, the current ticket balance (1,000 tickets as shown in the interface 700) is displayed for reference. The cog balance (1,781 as shown in the interface 700) is shown in the cog panel 704. In the example embodiment, the status panel 702 and the cog panel 704 may be selectable via user input to expand and/or provide additional options to the player. For example, selecting the status panel 702 may cause a customization interface to be presented. In another example, selecting the cog panel 704 may open an interface for purchasing cogs. The bonus game server 102 and/or the player device 110 may monitor the ticket and cog balances to provide up-to-date balances on the status panel 702 and the cog panel 704.

The tournament panels 706 present a plurality of options for participating in the bonus tournament game by offering different tournaments in which the players can participate. In the example embodiment, four tournaments are available to the players having increasing participation fees and associated jackpot awards. In other embodiments, a different number of tournaments (including one) may be provided. The participation fees and an award amount (e.g., the total amount of jackpot value to be awarded, a fixed jackpot award for the winning player, and/or a current value for the winning player's award) are displayed in each tournament panel.

As shown, despite the player having sufficient tickets to participate in any of the four tournaments, only one tournament is selectable as indicated by the highlight and icon change in tournament panel 707. This tournament is within an eligibility period (i.e., the associated bonus jackpot has exceed an associated eligibility threshold), while the remaining tournaments are not in their respective eligibility periods. In the example embodiment, to initiate the eligibility period for a particular bonus game tournament, the bonus game server 102 monitors 1506 the bonus jackpot to determine 1508 if the bonus jackpot has accrued a jackpot amount exceeding an eligibility threshold. If the bonus jackpot is less than the eligibility threshold, then base gameplay continues at the player devices 110 while the bonus jackpot continues to accrue additional funds. If the jackpot amount has exceeded the eligibility threshold, then the eligibility period of the bonus tournament game begins. In certain embodiments, players may track the progress of the bonus jackpot, such as via the information interface 700.

As the eligibility period begins, the bonus game server 102 performs a comparison between a participation fee of the bonus tournament game and the ticket balances of at least active players (i.e., players associated with player devices 110 actively connected to the bonus game server 102) to determine which players have sufficient tickets to participate. In certain embodiments, the ticket balances of inactive players may also be compared to the participation fee. Based on the comparison, the bonus game server 102 identifies any eligible players for the bonus tournament game and transmits 1510 participation requests to the eligible players. In other embodiments, the participation requests may be transmitted 1510 to any active player irrespective of eligibility. In such embodiments, eligibility may be determined by each player device 110 or in response to each player that attempts to accept the participation request.

In the example embodiment, the participation request transmitted 1510 to the player device 110 presenting the information interface may cause the tournament panel 707 to change in presentation from the appearance of the other tournament panels to the current appearance of the tournament panel 707 to indicate to the player that the associated tournament is open for participation. Selecting the tournament panel 707 may confirm the player's participation in the tournament, either directly or indirectly by causing a confirmation interface to be presented. The player device 110 may then transmit a message to the bonus game server 102 to indicate the player's confirmation, and the bonus game server 102 then adds 1512 the player to a tournament bracket of the bonus tournament game. It is to be understood that adding a player to the tournament bracket may not necessarily mean that the players have been seeded and matchups determined at the time of adding 1512 the players. Rather, in at least some embodiments, the players may be added to a roster of participating players to await a seeding process as described herein.

In the example embodiment, the bonus game server 102 initiates a participation timer during the eligibility period. The participation timer limits the eligibility period to a finite amount of time, thereby facilitating reduced wait times between bonus tournament games. That is, the eligibility period ends in response to the participation timer concluding, and to participate in the bonus tournament game, players may be required to accept the participation requests within the eligibility period if they wish to participate. The participation timer is initiated at an initial value and advances (either by increasing or decreasing) from the initial value towards a concluding threshold. In response to the participation time reaching or exceeding the concluding threshold (sometimes referred to herein as the participation timer "expiring"), the eligibility period is concluded. In one example, the concluding threshold is zero, and the initial value is set to a value such that the concluding threshold is reached in approximately thirty minutes. Other suitable values and thresholds may be used to calibrate the participation timer to expire after a particular time.

In certain embodiments, the bonus tournament game may require a minimum number of participating players, and the eligibility period may be configured to extend if the minimum number of participating players has not been reached. In such embodiments, either in response to reaching or exceeding the concluding threshold or another threshold value, the participation timer may be extended for a period of time. Extending the participation timer may include, but is not limited to, setting a new threshold beyond the concluding threshold, setting the current value of the participation timer to a new value, and/or adjusting the value of the concluding threshold. Once the minimum number of participating players is detected, the participation timer may expire, and the eligibility period concludes.

Figure 8:
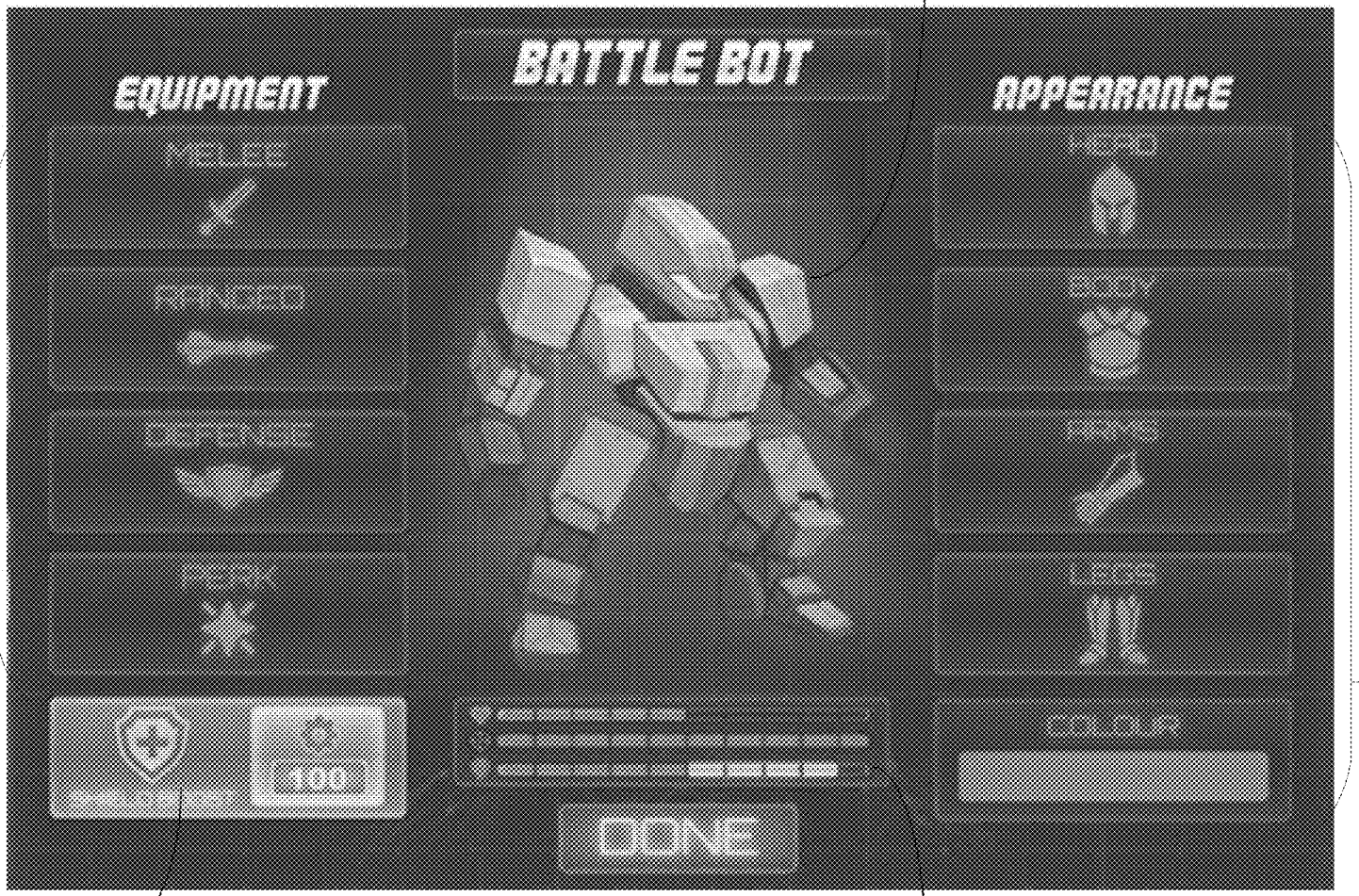
FIG. 8 is an image of an exemplary graphical interface indicating an avatar status for an example tournament bonus game, according to at least some embodiments of the present disclosure.

FIG. 8 depicts an example avatar interface 800 that may be presented in response to selecting the status panel 702 shown in FIG. 7. The avatar interface 800 includes a stats panel 802, a plurality of customization element panels 804, a boost panel 806, and an avatar preview 808. In other embodiments, the avatar interface 800 may have additional, fewer, or alternative graphical elements and/or user-selectable options, including those described elsewhere herein.

The stats panel 802 provides the player with an overview of the avatar's current statistics. For a battle tournament-based bonus game, the stats may include, for example, health, shields, attack power, and the like. These stats, as described in detail herein, may be factored into an outcome function such that the statistics of battling avatars may affect the outcome of each battle. In some embodiments, the stats panel 802 may be selectable by the player to expand the stats and provide the player with a detailed view of what is incorporated into the stats shown in the stats panel 802.

The customization element panels 804 are associated with a respective aspect or portion of the avatar that the player may customize for cosmetic purposes and/or to change the stats of the avatar. For example, the interface 800 depicts several stat-based customization elements that affect the stats (or provide other changes related to the outcome determination of the avatar battles) shown in the stats panel 802: Melee, Ranged, Defense, and Perk. The interface 800 also depicts several cosmetic customization elements that change the appearance of the avatar: Head, Body, Arms, Legs, and Color. In certain embodiments, the cosmetic customization elements may also affect the avatar's stats. Similarly, the stat-based customization elements may affect the appearance of the avatar. In other embodiments, a different number of customization elements and/or different types of customization elements may be available. To customize each customization element, the player may provide user input to select a particular customization element panel 804 to open a new interface.

The boost panel 806 is a user-selectable panel that may provide a bonus, stat change, and/or other change to the avatar that the player may purchase using cogs. In the example embodiment, the boost panel 806 increases the avatar's shield. The 'boost' provided by the boost panel 806 may be temporary or permanent. In certain embodiments, the avatar interface 800 may not include any boost panels. In other embodiments, a different number and/or type of boost panels 806 may be incorporated in the avatar interface 800.

The avatar preview 808 is a graphical representation of the avatar and the customization elements of the avatar. The player may reference the avatar preview 808, for example, to verify the appearance of the avatar and review visual changes to the avatar in response to customizing one or more customization elements. In certain embodiments, the avatar preview 808 may be interactive to enable the player to view particular animations, perspectives of the avatar, and the like.

Figure 9:
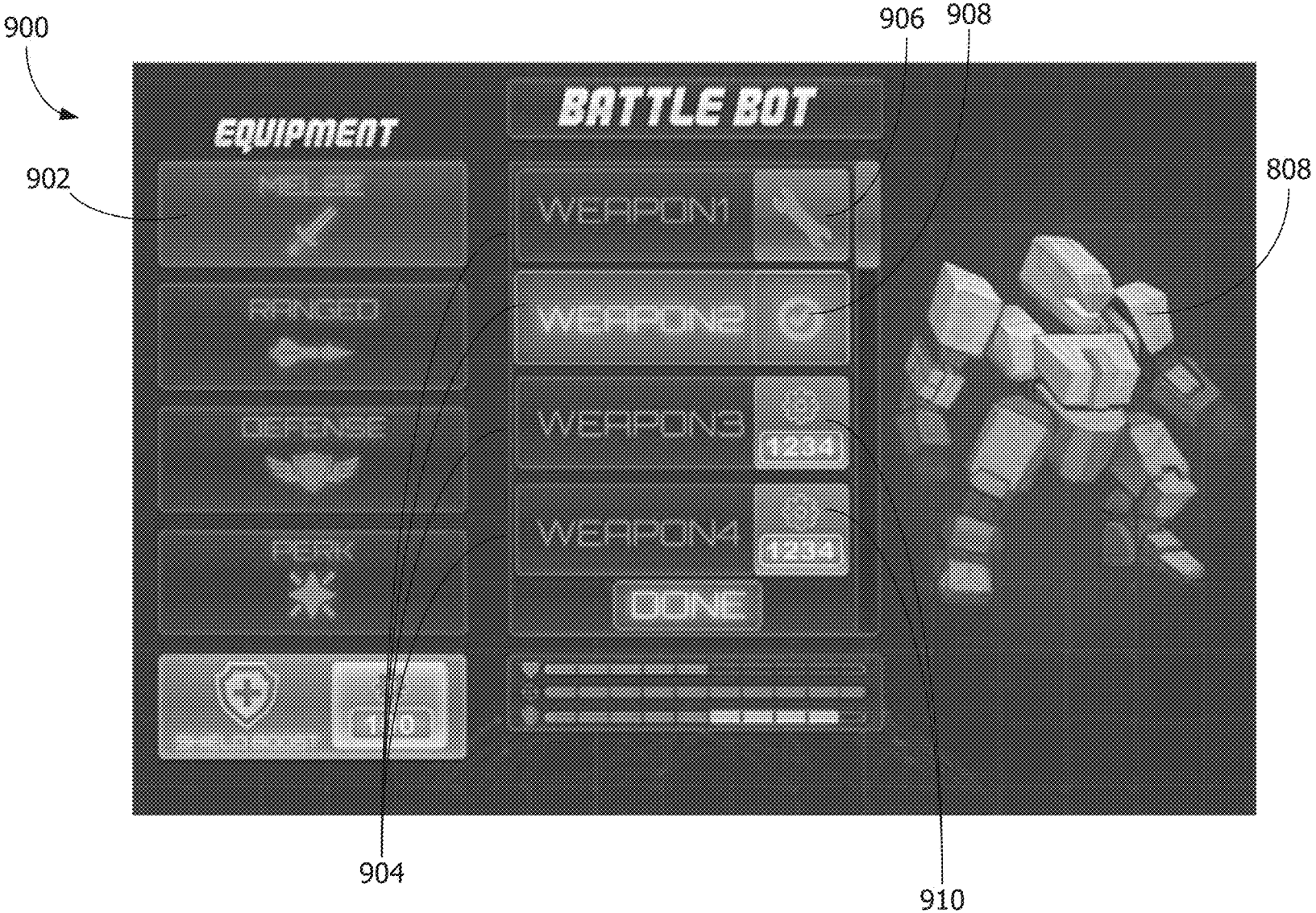
FIG. 9 is an image of an exemplary graphical interface for customizing an avatar for an example tournament bonus game, according to at least some embodiments of the present disclosure.

FIG. 9 depicts an example customization interface 900 that may be presented in response to the player selecting a particular customization element panel 804. More specifically, in this example, the "Melee" customization element panel 902 has been selected to open the interface 900. Within the interface 900, a plurality of customization option panels 904 are presented to the player. Each customization option panel 904 is associated with a particular customization option that can be slotted in the associated customization element of an avatar.

In the example shown in the interface 900, four melee weapons are available to be chosen by the player. Two of the weapons are "owned" by the player (i.e., available to be selected without additional purchase), while the remaining two weapons are available for purchase. More specifically, the first weapon panel 906 is associated with a melee weapon owned by the player but is unequipped (as visually shown to the player by the wrench icon in the panel 906), the second weapon panel 908 is associated with the currently equipped weapon, and the third and fourth weapon panels 910 are associated with purchasable weapons. In other embodiments, a different number of customization options may be provided.

In the example embodiment, the cogs are used to purchase customization options. Once purchased, the customization options may be selectively equipped on the avatar by the player. In at least some embodiments, for stat-based customization elements, a change in the stats based on the selected customization option may be visually shown (e.g., within the stats panel 802) to the player. Changes to appearance may be reflected on the avatar preview 808.

When a customization element is purchased, the player device 110 notifies the bonus game server 102. In response to receiving 1514 indication of the player input selecting a customization option, the bonus game server 102 decrements the purchase value from the player's cog balance. The bonus game server 102 may also update 1516 player avatar data associated with the player to track the player's purchased items and equipped customization options. In some embodiments, the graphical packages that form the avatar and any owned customization options may be stored separately from the player avatar data such that, when graphically generating the avatar, the player avatar data points or refers to the graphical packages including the graphical objects that form the avatar, thereby reducing the data storage burden of storing a plurality of avatars. In one example, the player avatar data includes a bitmask representing the avatar and the equipped customization options. The bitmask may be transmitted to the player devices 110 during presentation of the avatar battles to enable the player devices 110 to display the correct avatar.

Figure 10:
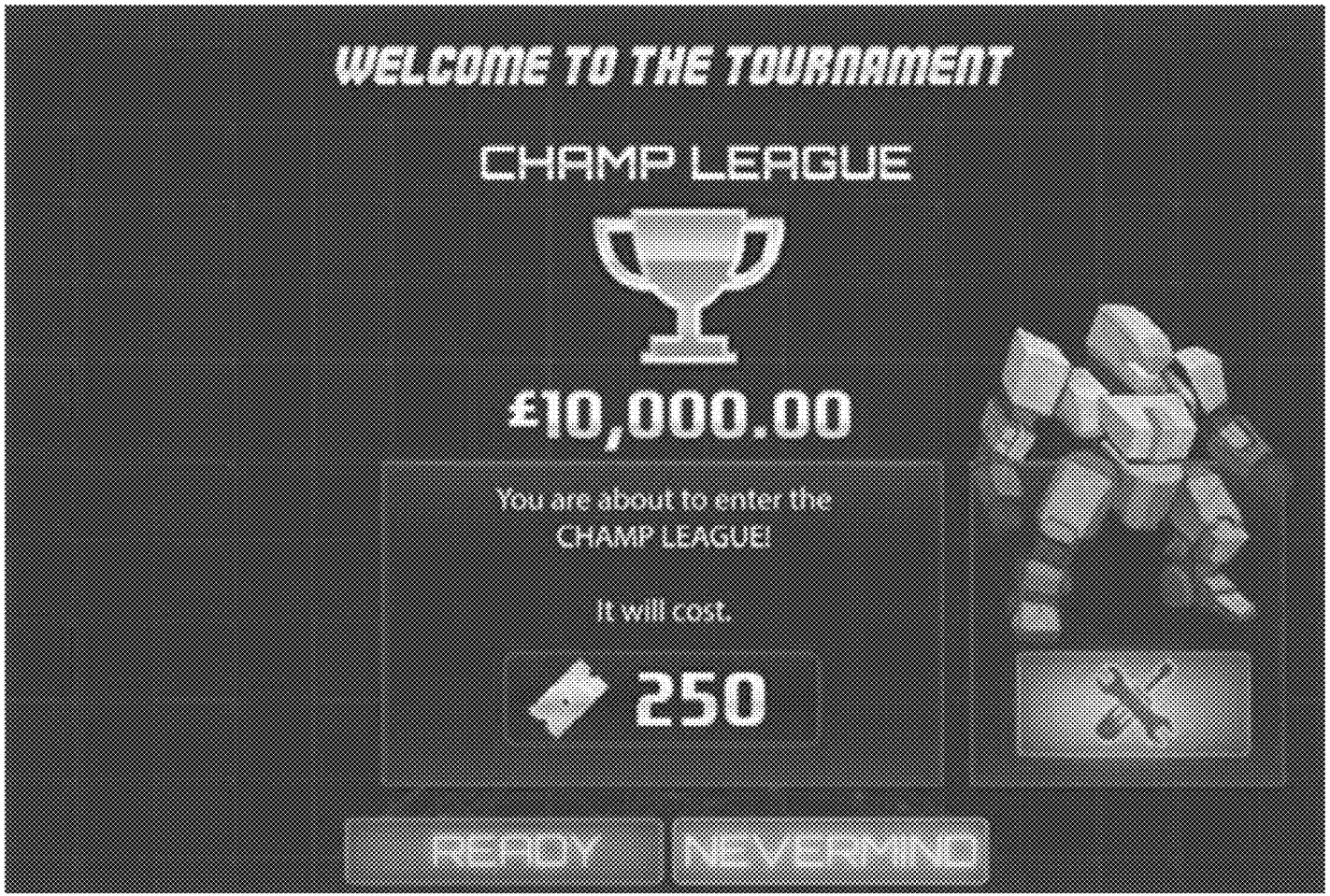
FIG. 10 is an image of an exemplary graphical interface for confirming participation in an example tournament bonus game, according to at least some embodiments of the present disclosure.

FIG. 10 illustrates an example confirmation interface 1000 that may be displayed in response to the player selecting a particular tournament game feature from the information interface 700 shown in FIG. 7. The confirmation interface 1000 is presented to provide additional security against unintended selection of a tournament game feature. That is, to enter a particular tournament, the player must select the tournament from the information 700 and confirm the selection on the confirmation interface 1000. In other embodiments, the confirmation interface 1000 may include additional, fewer, or alternative elements, including those described elsewhere herein.

In the example embodiment, the player has selected the "Champ League" from the information interface 700. The confirmation interface 1000 reiterates the participation fee and bonus game prize for the tournament. The player may review this information and either proceed with entering the tournament or decline participation. The confirmation interface 1000 also includes an avatar panel that causes the avatar panel 800 (shown in FIG. 8) to be displayed to enable the player to make last-minute changes to his or her avatar.

Figure 11:
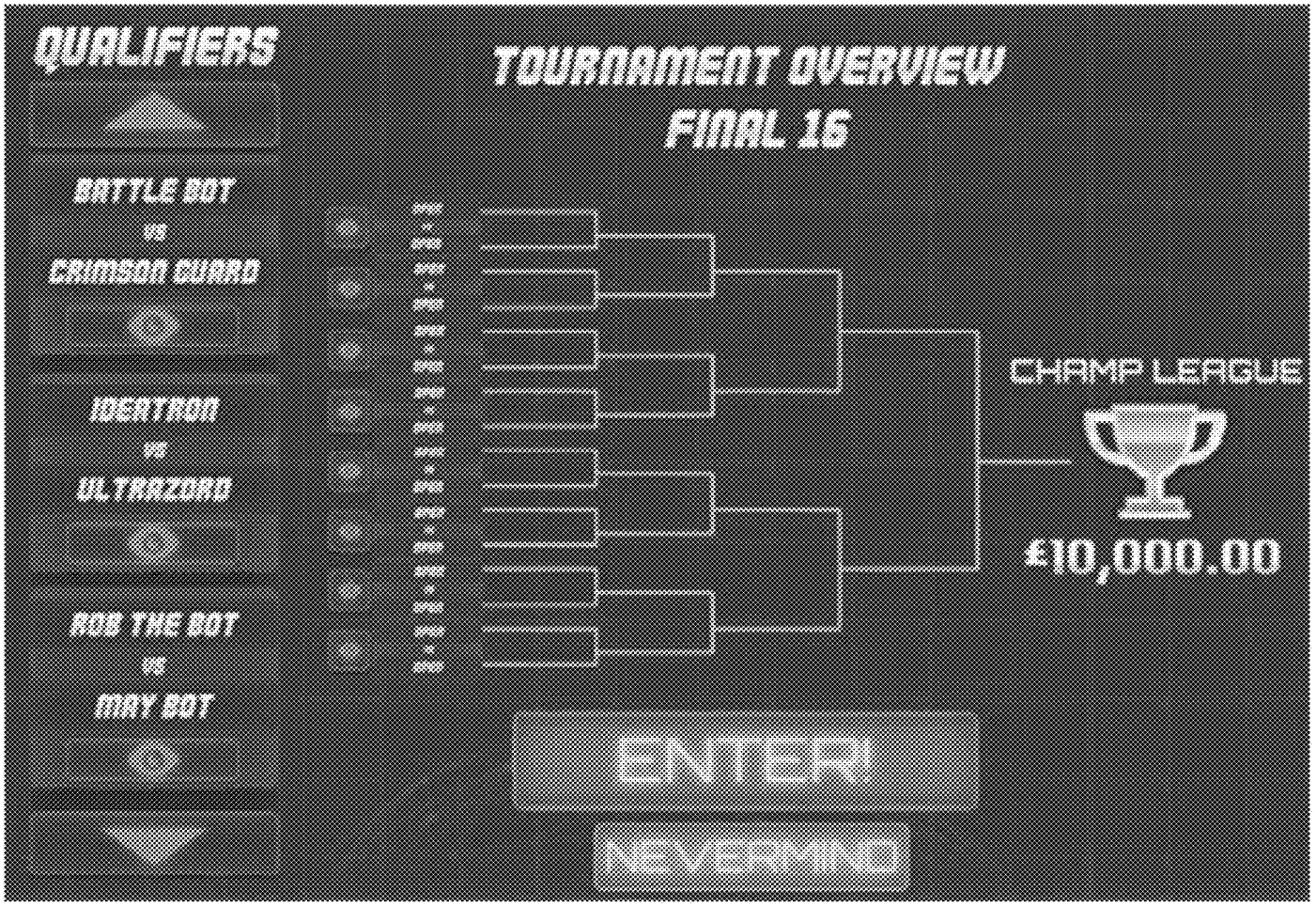
FIG. 11 is an image of an exemplary graphical interface for a tournament overview of an example tournament bonus game, according to at least some embodiments of the present disclosure.

FIG. 11 illustrates an example tournament overview interface 1100 that may be presented to at least participating players after the bonus tournament game has begun. The bonus tournament game may begin in response to conclusion of the eligibility period. In the example embodiment, the bonus game server 102 determines 1518 whether or not the participation timer has expired. If the timer has expired, the eligibility period is concluded, and the roster of participating players is set. The tournament overview interface 1100 includes a bracket of avatar battle matchups. The avatar battle matchups are organized from avatars of the participating players and, in some embodiments with an uneven number of participating players, non-player character (NPC) avatars. The seeding of the tournament may be determined by the bonus game server 102 using any suitable method. For example, the seeding may pair avatars of similar or different stats together for the initial pairings of the tournament. In another example, the seeding may be based on past performance of the avatars in prior tournaments.

In the example embodiment, the bonus game server 102 is configured to generate 1520 every outcome of the tournament immediately without waiting for each outcome or set of outcomes to be presented on the player devices 110. An outcome within the tournament may include, but is not limited to, the outcome of each matchup, the outcome of a round, and any other suitable, discrete outcome within the bonus tournament game. To synchronize presentation of the outcomes across the plurality of player devices 110, the bonus game server 102 may be configured to generate a timestamp for each outcome, where each outcome is presented by the player devices 110 according to the respective timestamps. The timestamps may be generated using a synchronization clock accessible to the bonus game server 102 and the player devices 110. The outcomes and the associated timestamps are transmitted 1522 from the bonus game server 102 to the player devices 110 for presentation of the tournament. Timestamped outcomes enable the player devices 110 to disconnect from the bonus game server 102 without interrupting the presentation of the tournament.

The player may choose to 'enter' the tournament to view the graphical presentation of the avatar battles or leave while the tournament progresses in the background. During the tournament, the tournament overview interface 1100 may be updated in response to each matchup outcome being revealed such that players may keep track of the tournament.

As the tournament progresses, avatar battles are presented on the player devices 110, and the outcomes of the avatar battles are used to determine tournament progression and awards. In at least some embodiments, the tournament overview interface 1100 may be accessible by other users (referred to herein as "spectators") beyond the participating players. The spectators may view the tournament progression and, in certain embodiments, interact with the tournament. For example, wagers and prop bets may be placed on the avatar battles and outcomes by the spectators. These wagers may be placed through the tournament overview interface 1100 or via a different interface.

Figure 12:
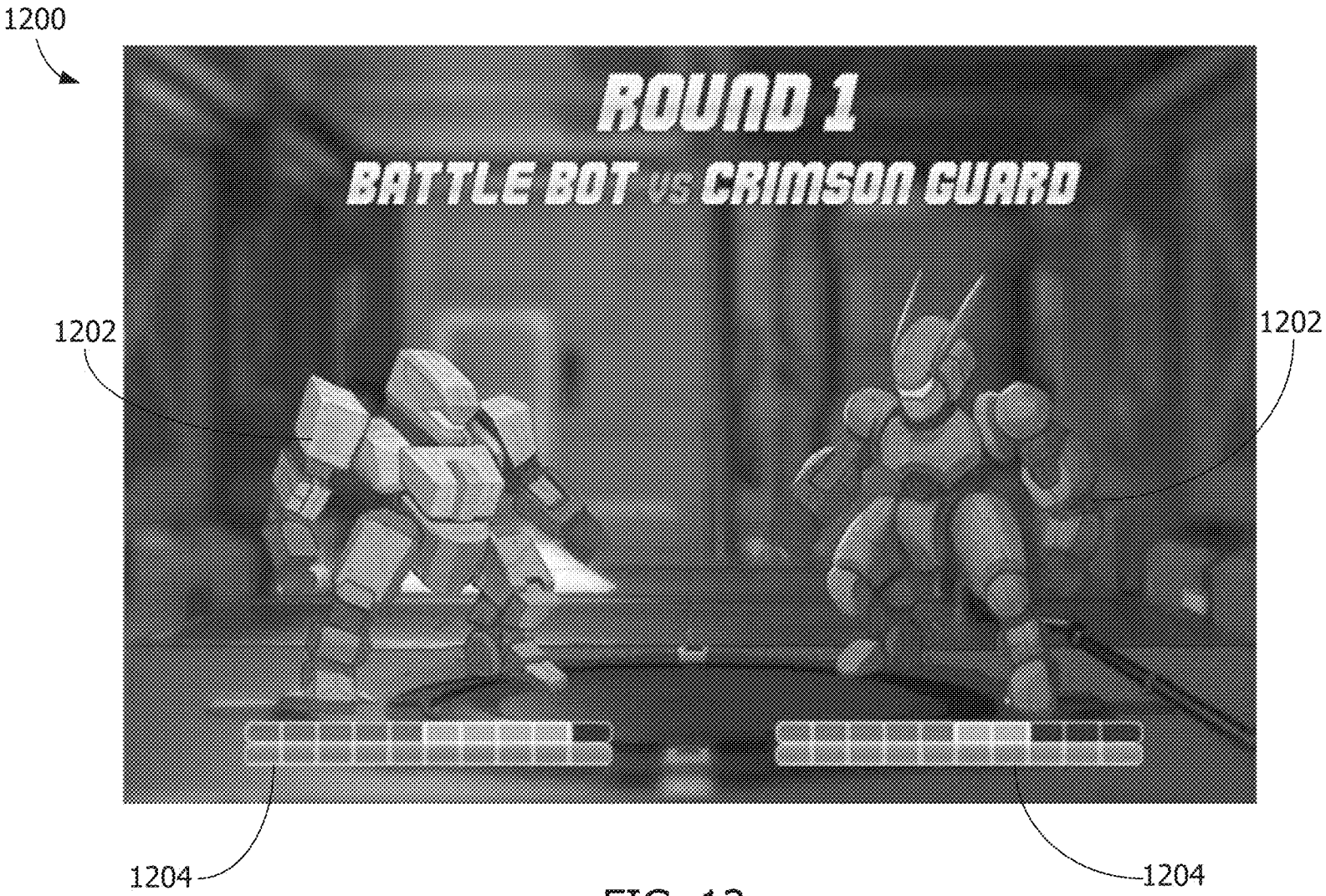
FIG. 12 is an image of an exemplary graphical interface of an avatar match for an example tournament bonus game, according to at least some embodiments of the present disclosure.

FIG. 12 is an example battle interface 1200 that may be presented during a matchup of the bonus tournament game. The battle interface 1200 includes opposing avatars 1202 and the corresponding stats 1204 of each avatar 1202. The battle interface 1200 may be configured to present several animations with the avatars 1202 to simulate a battle, while the stats 1204 reflect the outcomes of the animations. In one example, the outcomes determined by the bonus game server 102 for each battle include one or more 'rounds' within the battle in which each avatar 1202 takes one or more actions. The result of each round may cause the health, shields, or other metric of an avatar 1202 to decrease (or increase) until one of the avatars is defeated (e.g., a health stat of an avatar 1202 reaches zero). In another example, a single outcome for the battle may be determined by bonus game server (i.e., which avatar won the battle), and the animation of the battle may be generated randomly by the player devices 110 and/or the bonus game server 102 to achieve the determined outcome.

As the battles progress, players and their avatars are eliminated from the bonus tournament game until a winning player is determined. The bonus game server 102 awards 1524 one or more bonus game prizes to at least the winning player. More specifically, the bonus game server 102 awards 1524 a jackpot award to at least the winning player. FIG. 13 depicts an example winning interface 1300 that is displayed to the winning player. In at least some embodiments, the bonus game server 102 is configured to wait until the winning player is presented (e.g., either at the end of the final battle or in response to the winning interface 1300 being displayed) before providing the award to the winning player. In the example embodiment, the bonus game prize for the winning player is a jackpot award. The bonus game server 102 notifies the jackpot services server 108 of the identity of the winning player (e.g., by transmitting the player identifier of the registered player data to the jackpot services server 108) to credit the winning player with the jackpot award.

Similar to the winning interface 1300, FIG. 14 illustrates an example consolation interface 1400 that may be presented to a participating player that is eliminated from the bonus tournament game. In the example embodiment, the bonus game prize for the eliminated player is an amount of cogs that the bonus game server 102 credits to the player's cog balance. It is to be understood that other bonus game prizes, combinations of bonus game prizes, and prize amounts beyond the prizes shown in the winning interface 1300 and the consolation interface 1400 may be awarded.

It is to be understood that the example bonus tournament game described with respect to FIGS. 6-15 is for exemplary purposes only, and that other suitable bonus tournament games may be implemented using the foregoing systems and methods. The foregoing systems and methods facilitate enhanced management of bonus games with progressive jackpots by initiating an eligibility period for the bonus games based on a jackpot amount achieving or approaching a fully funded amount, thereby increasing the rate at which the bonus games are conducted.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

The invention claimed is:

1. A gaming system comprising:

a bonus game server comprising game-logic circuitry configured to:

monitor a plurality of bonus ticket balances associated with a plurality of players, the plurality of bonus ticket balances configured to accrue bonus tickets during play of at least one base wagering game, wherein each player of the plurality of players is associated with a bonus game avatar having at least one customization element and an avatar type of a plurality of avatar types;

monitor a bonus jackpot associated with a bonus tournament game, the bonus jackpot accrued at least partially from wagers placed during the at least one base wagering game;

in response to an amount of the bonus jackpot exceeding an eligibility threshold, transmit participation requests to player devices of eligible players from the plurality of players, the eligible players associated with (i) respective bonus ticket balances exceeding an eligibility amount and (ii) bonus game avatars comprising a first avatar type of the plurality of avatar types, wherein the bonus game avatars of the first avatar type are ineligible for participation in a second bonus tournament game for a second bonus jackpot;

initiate a participation timer associated with the participation requests;

in response to at least one of the eligible players accepting the participation request, enter the at least one eligible player into the bonus tournament game and deduct a participation fee from the respective bonus ticket balance associated with the at least one eligible player;

in response to the participation timer reaching a concluding threshold, generate, using a random number generator of the bonus game server, one or more random numbers to determine at least one outcome of the bonus tournament game, the at least one outcome of the bonus tournament game representing at least one match between bonus game avatars of the participating players, wherein each of the at least one outcome is a non-skill-based outcome determined at least partially a function of the one or more random numbers and the at least one customization element of the bonus game avatars associated with the outcome; and award a bonus game prize from the bonus jackpot to a winning player of the participating players identified at least partially by the at least one outcome of the bonus tournament game.

2. The gaming system of claim 1, wherein each of the at least one customization element is associated with one customization option of a plurality of player-selectable customization options purchasable using an avatar currency awarded in response to one or more trigger events of the at least one base wagering game, and wherein an amount of the avatar currency awarded in response to the one or more trigger events is at least partially a function of at least one of wager frequency or wager amount within the at least one base wagering game over a period of time.

3. The gaming system of claim 1, wherein the bonus game server is configured to transmit the at least one outcome of the bonus tournament game to the player devices of the participating players, the player devices configured to present the at least one outcome graphically as a battle between bonus game avatars.

4. The gaming system of claim 1, wherein an amount of bonus tickets awarded to a player varies based on a wager amount provided by the player for play of the at least one base wagering game.

5. The gaming system of claim 1, wherein the game-logic circuitry extends the concluding threshold in response to determining a number of participating players from the eligible players is less than a minimum participation threshold.

6. The gaming system of claim 1, wherein the plurality of players is limited to players actively participating in one or more wagering games.

7. The gaming system of claim 1, wherein the eligibility threshold is less than a required jackpot amount to fund at least the bonus game prize of the winning player.

8. The gaming system of claim 1, wherein the bonus game avatars comprise the first avatar type, a second avatar type, and a third avatar type, and wherein eligibility for the bonus game tournament is limited to players of the plurality of players having bonus game avatars of the first avatar type or the second avatar type.

9. The gaming system of claim 1, wherein the plurality of players includes at least one inactive player not associated with any currently active gaming session.

10. A method of conducting a bonus tournament game using a gaming system including a bonus game server, the method comprising:

monitoring, by game-logic circuitry of the bonus game server, a plurality of bonus ticket balances associated with a plurality of players, the plurality of bonus ticket balances configured to accrue bonus tickets during play of at least one base wagering game, wherein each player of the plurality of players is associated with a bonus game avatar having at least one customization element and an avatar type of a plurality of avatar types;

monitoring, by the game-logic circuitry, a bonus jackpot associated with a bonus tournament game, the bonus jackpot accrued at least partially from wagers placed during the at least one base wagering game;

in response to an amount of the bonus jackpot exceeding an eligibility threshold, transmitting, by the game-logic circuitry, participation requests to player devices of eligible players from the plurality of players, the eligible players associated with (i) respective bonus ticket balances exceeding an eligibility amount and (ii) bonus game avatars comprising a first avatar type of the plurality of avatar types, wherein the bonus game avatars of the first avatar type are ineligible for participation in a second bonus tournament game for a second bonus jackpot;

initiating, by the game-logic circuitry, a participation timer associated with the participation requests;

in response to at least one of the eligible players accepting the participation request, entering, by the game-logic circuitry, the at least one eligible player into the bonus tournament game and deducting a participation fee from the respective bonus ticket balance associated with the at least one eligible player;

in response to the participation timer reaching a concluding threshold, generating, by a random number generator of the bonus game server, one or more random numbers to determine at least one outcome of the bonus tournament game, the at least one outcome of the bonus tournament game representing at least one match between bonus game avatars of the participating players, wherein each of the at least one outcome is a non-skill-based outcome determined at least partially a function of the one or more random numbers and the at least one customization element of the bonus game avatars associated with the outcome; and awarding, by the game-logic circuitry, a bonus game prize from the bonus jackpot to a winning player of the participating players identified at least partially by the at least one outcome of the bonus tournament game.

11. The method of claim 10, wherein each of the at least one customization element is associated with one customization option of a plurality of player-selectable customization options purchasable using an avatar currency awarded in response to one or more trigger events of the at least one base wagering game, and wherein an amount of the avatar currency awarded in response to the one or more trigger events is at least partially a function of at least one of wager frequency or wager amount within the at least one base wagering game over a period of time.

12. The method of claim 10, wherein the bonus game server is configured to transmit the at least one outcome of the bonus tournament game to the player devices of the participating players, the player devices configured to present the at least one outcome graphically as a battle between bonus game avatars.

13. The method of claim 10, wherein an amount of bonus tickets awarded to a player varies based on a wager amount provided by the player for play of the at least one base wagering game.

14. The method of claim 10 further comprising extending, by the game-logic circuitry, the concluding threshold in response to determining a number of participating players from the eligible players is less than a minimum participation threshold.

15. The method of claim 10, wherein the bonus game avatars comprise the first avatar type, a second avatar type, and a third avatar type, and wherein eligibility for the bonus game tournament is limited to players of the plurality of players having bonus game avatars of the first avatar type or the second avatar type.

16. The method of claim 10, wherein the plurality of players includes at least one inactive player not associated with any currently active gaming session.

17. A bonus game server comprising game-logic circuitry configured to:

monitor a plurality of bonus ticket balances associated with a plurality of players, the plurality of bonus ticket balances configured to accrue bonus tickets during play of at least one base wagering game, wherein each player of the plurality of players is associated with a bonus game avatar having at least one customization element and an avatar type of a plurality of avatar types;

monitor a bonus jackpot associated with a bonus tournament game, the bonus jackpot accrued at least partially from wagers placed during the at least one base wagering game;

in response to an amount of the bonus jackpot exceeding an eligibility threshold, transmit participation requests to player devices of eligible players from the plurality of players, the eligible players associated with (i) respective bonus ticket balances exceeding an eligibility amount and (ii) bonus game avatars comprising a first avatar type of the plurality of avatar types, wherein the bonus game avatars of the first avatar type are ineligible for participation in a second bonus tournament game for a second bonus jackpot;

initiate a participation timer associated with the participation requests;

in response to at least one of the eligible players accepting the participation request, enter the at least one eligible player into the bonus tournament game and deduct a participation fee from the respective bonus ticket balance associated with the at least one eligible player;

in response to the participation timer reaching a concluding threshold, generate, using a random number generator of the bonus game server, one or more random numbers to determine at least one outcome of the bonus tournament game, the at least one outcome of the bonus tournament game representing at least one match between bonus game avatars of the participating players, wherein each of the at least one outcome is a non-skill-based outcome determined at least partially a function of the one or more random numbers and the at least one customization element of the bonus game avatars associated with the outcome; and award a bonus game prize from the bonus jackpot to a winning player of the participating players identified at least partially by the at least one outcome of the bonus tournament game.

18. The bonus game server of claim 17, wherein the bonus game server is configured to transmit the at least one outcome of the bonus tournament game to the player devices of the participating players, the player devices configured to present the at least one outcome graphically as a battle between bonus game avatars.

19. The bonus game server of claim 17, wherein an amount of bonus tickets awarded to a player varies based on a wager amount provided by the player for play of the at least one base wagering game.

20. The bonus game server of claim 17, wherein the game-logic circuitry extends the concluding threshold in response to determining a number of participating players from the eligible players is less than a minimum participation threshold.

* * * * *